US009811019B2

(12) United States Patent
Kamae et al.

(10) Patent No.: US 9,811,019 B2
(45) Date of Patent: Nov. 7, 2017

(54) MAGNETIC CARRIER AND TWO-COMPONENT DEVELOPER

(75) Inventors: Kentaro Kamae, Kashiwa (JP); Nozomu Komatsu, Toride (JP); Koh Ishigami, Abiko (JP); Yoshinobu Baba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/129,493

(22) PCT Filed: Jun. 21, 2012

(86) PCT No.: PCT/JP2012/066463

§ 371 (c)(1),
(2), (4) Date: Mar. 31, 2014

(87) PCT Pub. No.: WO2013/002296

PCT Pub. Date: Jan. 3, 2013

(65) Prior Publication Data

US 2014/0220487 A1 Aug. 7, 2014

(30) Foreign Application Priority Data

Jun. 29, 2011 (JP) ..... 2011-144644

(51) Int. Cl.

| | |
|---|---|
| ***G03G 9/10*** | (2006.01) |
| ***G03G 9/113*** | (2006.01) |
| ***G03G 9/107*** | (2006.01) |

(52) U.S. Cl.

CPC ..... *G03G 9/1133* (2013.01); *G03G 9/1075* (2013.01); *G03G 9/1131* (2013.01); *G03G 9/1136* (2013.01)

(58) Field of Classification Search

CPC .... G03G 9/0839; G03G 9/113; G03G 9/1075; G03G 9/1133; G03G 9/1136; G03G 9/1131

(Continued)

(56) References Cited

U.S. PATENT DOCUMENTS 5,631,116 A * 5/1997 Uchida et al. ..... 430/111.1
2008/0241726 A1 10/2008 Kobayashi (Continued)

FOREIGN PATENT DOCUMENTS

CN 101600997 A 12/2009
EP 1975732 A2 10/2008

(Continued)

*Primary Examiner* — Thorl Chea

(74) *Attorney, Agent, or Firm* — Canon U.S.A., Inc. IP Division

(57) ABSTRACT

A magnetic carrier is provided which can suppress a decrease in glossiness even in a long term use for POD which requires high glossiness. A magnetic carrier includes a filled core particle in which a silicone resin is filled in pores of a porous magnetic core particle and a vinyl resin coating a surface of the filled core particle. In a pore distribution of the porous magnetic core particle measured by a mercury intrusion method, a cumulative pore volume in a pore diameter range of 0.1 to 3.0 μm is 35.0 to 95.0 $mm^3/g$, and in a pore distribution of the filled core particle measured by a mercury intrusion method, a cumulative pore volume in a pore diameter range of 0.1 to 3.0 μm is 3.0 to 15.0 $mm^3/g$. The magnetic carrier includes 1.2 to 3.0 parts by mass of the vinyl resin to 100.0 parts by mass of the filled core particle.

2 Claims, 3 Drawing Sheets

(58) Field of Classification Search
USPC ..... 430/111.35, 113, 113.31
See application file for complete search history.

(56) References Cited

U.S. PATENT DOCUMENTS

| | | | | |
|---|---|---|---|---|
| 2009/0263739 | A1 | 10/2009 | Sugiura | |
| 2010/0028796 | A1* | 2/2010 | Nakamura et al. ..... | 430/110.3 |
| 2010/0055601 | A1 | 3/2010 | Sugiura | |
| 2010/0248125 | A1 | 9/2010 | Hikichi | |

FOREIGN PATENT DOCUMENTS

| | | | |
|---|---|---|---|
| EP | 2312396 | A1 | 4/2011 |
| JP | 4001606 | B2 | 10/2007 |
| JP | 2008-242348 | A | 10/2008 |
| JP | 2009-205149 | A | 9/2009 |
| JP | 2009-237525 | A | 10/2009 |
| JP | 2009-244837 | A | 10/2009 |
| JP | 2010-039133 | A | 2/2010 |
| JP | 2010-049140 | A | 3/2010 |
| JP | 2010-055014 | A | 3/2010 |
| JP | 2010-152383 | A | 7/2010 |
| JP | 2010-256855 | A | 11/2010 |
| WO | 2010/016601 | A1 | 2/2010 |

* cited by examiner

MAGNETIC CARRIER AND TWO-COMPONENT DEVELOPER

TECHNICAL FIELD

The present invention relates to a magnetic carrier used for an image forming method which visualizes an electrostatic image using an electrophotography technique and a two-component developer using the same.

BACKGROUND ART

In recent years, since variable information can be easily printed from electronic data, an electrophotographic system has been increasingly employed in an on-demand printing (POD) market which is a light printing field. In POD, it has been required that printing be performed on a recording material other than recording materials (sheets) used for image formation of the electrophotographic system in the past. As a particular example of such a recording material, for example, thick paper used as a cover sheet of a magazine, paper for advertising poster, gloss paper used as paper having high quality feeling, and coated paper used as a robust card coated with a wax or a poly(lactic acid) latex may be mentioned.

In association with the above requirement, further improvement in performance of a magnetic carrier used for a two-component development method has been desired. In recent years, in order to decrease the specific gravity of the magnetic carrier and to control the resistance thereof, it has been performed that a resin is filled in voids of a porous magnetic core particle.

PTL 1 has disclosed a resin-filled type magnetic carrier which achieves a decrease in specific gravity by filling voids of a porous magnetic core particle with a silicone resin. However, although the durability of the magnetic carrier disclosed in PTL 1 can be improved by the decrease in specific gravity, development properties are inferior, and an image defect, such as a white spot, at a boundary between a halftone image and a solid image may arise in some cases. In addition, in order to compensate for insufficient development properties, when Vpp (peak-to-peak voltage) of a developing bias, which is an alternating bias voltage, is set high, charge is injected into an electrostatic image through a magnetic carrier by a developer support, and an electrostatic latent image support may have the same potential as that of the electrostatic image, that is, so-called leakage may occur in some cases.

In order to simultaneously achieve improvement in development properties and suppression of leakage, in PTL 2, a magnetic carrier has been disclosed in which a resin portion of a surface of a resin-filled type magnetic carrier particle is optimally distributed, and an electric field strength immediately before a porous magnetic core particle is electrically broken down is specified. However, when printing is performed on many pieces of glossy paper by a developer using the resin-filled type magnetic carrier disclosed in PTL 2, although an image having sufficient glossiness can be obtained at an early stage, the glossiness of image may be decreased with time in some cases. The reason for this is believed that a silicone resin contained in the magnetic carrier is scraped off as described later. Although such a decrease in glossiness causes not any particular problems when intra-office documents and drawings are printed, the decrease in glossiness becomes a problem when high glossiness is required as in the case of POD.

PTL 3 has disclosed a carrier in which an acrylic resin coats a surface of a filled core particle formed by filling pores of a porous magnetic core particle with a silicone resin. However, since the silicone resin and the acrylic resin are not well compatible with each other, the surface of the magnetic carrier can only be sparsely coated with the acrylic resin. As a result, since the silicone resin is partially exposed, when many sheets are printed, the silicone resin will be scraped off, and the glossiness is decreased with time. In addition, since a uniform coating layer is not formed on the surface of the magnetic carrier, a locally low resistance portion is present on the surface of the magnetic carrier, and leakage may occur in some cases. Furthermore, since areas in which the silicone resin is exposed and areas which are coated with the acrylic resin are present at the same time on the surface of the magnetic carrier, the charge distribution of toner becomes broad, and as a result, fogging and density unevenness may occur in some cases.

As described above, it has been desired to obtain a magnetic carrier which achieves high glossiness as required in the case of POD and which also satisfies other performance necessary for the magnetic carrier.

CITATION LIST

Patent Literature

PTL 1 Japanese Patent No. 4001606
PTL 2 Japanese Patent Laid-Open No. 2010-039133
PTL 3 Japanese Patent Laid-Open No. 2010-256855

SUMMARY OF INVENTION

Technical Problem

The present invention provides a magnetic carrier which causes no decrease in glossiness even in a long-term use for POD that requires high glossiness and which can suppress leakage, fogging, density unevenness, and carrier adhesion.

Solution to Problem

The present invention relates to a magnetic carrier comprising a filled core particle which includes a porous magnetic core particle and a silicone resin filled in pores thereof; and a vinyl resin coating a surface of the filled core particle. In the magnetic carrier, in a pore distribution of the porous magnetic core particle measured by a mercury intrusion method, a cumulative pore volume in a pore diameter range of 0.1 to 3.0 μm is 35.0 to 95.0 $mm^3/g$, in a pore distribution of the filled core particle measured by a mercury intrusion method, a cumulative pore volume in a pore diameter range of 0.1 to 3.0 μm is 3.0 to 15.0 $mm^3/g$, and the content of the vinyl resin is 1.2 to 3.0 parts by mass with respect to 100.0 parts by mass of the filled core particle.

In addition, the present invention also relates to a two-component developer which uses the above magnetic carrier.

Advantageous Effects of Invention

According to the present invention, there is provided a magnetic carrier which causes no decrease in glossiness even in a long-term use for POD and which suppresses leakage, fogging, density unevenness, and carrier adhesion.

DESCRIPTION OF EMBODIMENTS

Figure 1A:
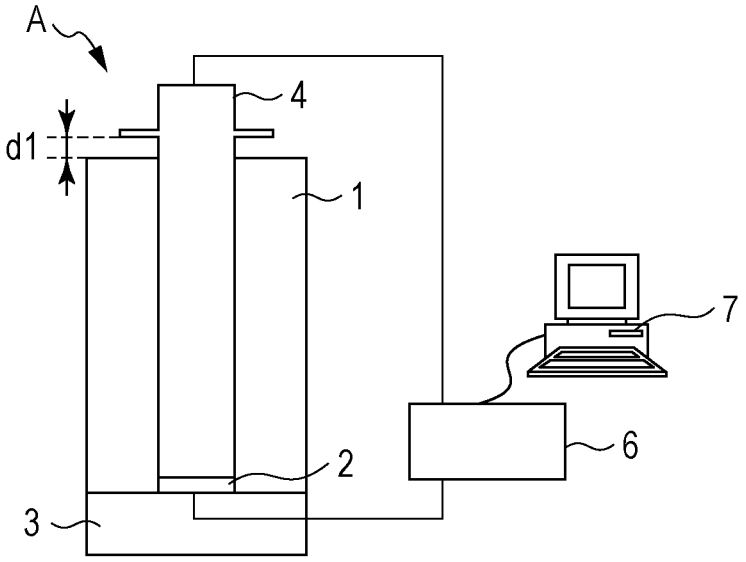
FIGS. 1A and 1B are each a schematic view of a measurement apparatus measuring the resistivity of a porous magnetic core particle and that of a magnetic carrier.

In the present invention, a filled core particle indicates a particle including a porous magnetic core particle and a resin filled in pores thereof. In addition, a magnetic carrier indicates an aggregate of particles (magnetic carrier particles) each including the filled core particle and a resin coating the surface thereof.

As described above, when printing is performed on many pieces of glossy paper using a related magnetic carrier, there has been a problem in that the glossiness of image is decreased with time. When the present inventors investigated this problem, it was confirmed that a Si element was contained in an image having decreased glossiness. The reason for this is considered as described below. A silicone resin used for filling or coating of the magnetic carrier is scraped off by a long-term use, and as a result, a fine powder of the silicone resin is generated. In addition, the fine powder of the silicone resin is mixed in a developed toner, and when a toner image is fixed, a wax contained in the toner is inhibited from permeation and spread, thereby decreasing the glossiness.

When only a vinyl resin which is not likely to inhibit permeation and spread of the wax was used for the magnetic carrier, the glossiness was not decreased with time. From this result, it is believed that the fine powder of the silicone resin derived from the magnetic carrier contributes to the decrease in glossiness of the image.

In addition, the reason the vinyl resin is not likely to inhibit permeation and spread of the wax is believed that since the difference in SP value between the wax and the vinyl resin is small, and the compatibility therebetween is high, melt mixing can be carried out in fixing. On the other hand, it is believed that since the difference in SP value between the wax and the silicone resin is large, and melt mixing is not carried out therebetween in fixing, permeation and spread of the wax is blocked by the silicone resin.

In order to prevent the decrease in glossiness with time, it is important to suppress scraping of the silicone resin contained in the magnetic carrier. As a method therefor, for example, a method may be mentioned in which as a resin coating a surface of a filled core particle which uses a silicone resin as a resin (hereinafter referred to as "filling resin"") filled in pores of a porous magnetic core particle, a vinyl resin is used. However, since the compatibility between the silicone resin and the vinyl resin is not good, the filled core particle is only sparsely coated when the surface thereof is simply coated with the vinyl resin. As a result, areas in which the silicone resin of the filled core particle is exposed are present. Even if the amount of the vinyl resin used for coating is increased, or coating of the filling resin is repeatedly performed by a multi-step process, the exposure of the silicone resin is not improved.

In addition, although a method in which the vinyl resin is used both as the filling resin and the coating resin may be considered, the impregnating ability of the vinyl resin into the pores of the porous magnetic core particle is low, and the resin is not sufficiently filled. Therefore, since voids may be formed in the pores of the filled core particle, the resistance of the magnetic carrier is decreased, and leakage may occur in some cases.

Accordingly, in order to obtain a magnetic carrier in which the silicone resin is not exposed from the surface thereof and which is uniformly coated with a resin, intensive research was carried out by the present inventors. As a result, the present inventors found out that it was important to control the state of the pores of the porous magnetic core particle and that of the pores of the filled core particle and to control the amount of the coating resin, and finally the present invention was made.

A magnetic carrier of the present invention uses a silicone resin as the filling resin. Since the silicone resin is significantly excellent in impregnating ability, even the inside of pores of porous magnetic core particle is filled with the resin. In addition, a vinyl resin is used as the coating resin. In the present invention, in order to sufficiently coat the surface of the filled core particle with the vinyl resin and to prevent exposure of the silicone resin used as the filling resin, the following characteristic structure is employed.

That is, according to the magnetic carrier of the present invention, in a pore distribution of the porous magnetic core particle measured by a mercury intrusion method, a cumulative pore volume in a pore diameter range of 0.1 to 3.0 μm is 35.0 to 95.0 $mm^3/g$, and in a pore distribution of the filled core particle measured by a mercury intrusion method, a cumulative pore volume in a pore diameter range of 0.1 to 3.0 μm is 3.0 to 15.0 $mm^3/g$. Accordingly, there is a sufficient number of pores of the porous magnetic core particle into which the resin is to be filled. In addition, the surface of the filled core particle has an irregular shape due to the pores, and by this irregularity of the surface of the filled core particle, the coating property of the vinyl resin to the filled core particle can be improved.

The reason the coating property of the vinyl resin is improved by the above structure is resulting from the surface tension of the vinyl resin and the contact area of the porous magnetic core particle having high compatibility with the vinyl resin. That is, since the convex portion of the surface of the filled core particle is a portion at which the porous magnetic core particle is exposed and has a high compatibility with the vinyl resin, the convex portion of the surface of the filled core particle is coated with the vinyl resin. On the other hand, since the silicone resin functioning as the filling resin is present at the concave portion of the surface of the filled core particle, the compatibility of this portion with the vinyl resin is low. However, if an exposed surface of the porous magnetic core particle is present on a wall surface of the concave portion, by the surface tension, the vinyl resin will permeate the concave portion of the filled core particle, and the portion at which the silicone resin is present is also coated.

In addition, the reason the attention is paid to a pore diameter range of 0.1 to 3.0 μm of the pore distribution of the porous magnetic core particle and that of the filled core particle is as follows. In the measurement of the pore distribution by a mercury intrusion method, in a region larger than a pore diameter of 3.0 μm of the pore distribution, spaces between the particles are also measured, and accurate pore distribution cannot be measured. In addition, in the porous magnetic core particle and the filled core particle, in general, pores larger than 3.0 μm are hardly present. For such a reason, the upper limit of the pore diameter is set to 3.0 μm when the cumulative pore volume is computed. In addition, in general, since a pore smaller than 0.1 μm is hardly present, the lower limit of the pore diameter is set to 0.1 μm when the cumulative pore volume is computed.

When the cumulative pore volume of the porous magnetic core particle is less than 35 $mm^3/g$, the amount of the resin to be filled in the porous magnetic core particle is not enough, and since the amount of the resin to the porous magnetic core particle is decreased, the resistance as the magnetic carrier is decreased. As a result, leakage, fogging, and density unevenness may occur in some cases. In addition, when the cumulative pore volume of the porous magnetic core particle is more than 95 $mm^3/g$, the inside of the porous magnetic core particle will be filled with a large amount of the resin, and the amount thereof may be excessive to that of the porous magnetic core particle. As a result, the magnetic carrier may have a high resistance, and degradation in development properties and carrier adhesion may occur in some cases.

When the cumulative pore volume of the filled core particle is less than 3.0 $mm^3/g$, pores hardly remain in the vicinity of the surface of the filled core particle, and irregularities caused by the pores are not sufficiently formed in the surface of the filled core particle. Therefore, the silicone resin functioning as the filling resin occupies most of the surface of the filled core particle, and as a result, sufficient coating by the vinyl resin is difficult to perform. Hence, the glossiness may be decreased with time in some cases since the silicone resin is scraped off as described above.

When the cumulative pore volume of the filled core particle is larger than 15.0 $mm^3/g$, the porous magnetic core particle is not sufficiently filled with the resin, and the filled core particle has a relatively deep concave portion. Therefore, if the coating is performed by a vinyl resin having a low impregnating ability, voids may remain inside the magnetic carrier particle, and as the magnetic carrier, the resistance thereof is decreased. As a result, leakage, fogging, and density unevenness may occur in development.

The average pore diameter of the porous magnetic core particle is preferably 0.7 to 1.4 μm and is more preferably 0.9 to 1.3 μm. When the average pore diameter is within the range described above, the distance between two sides of the concave portion of the porous magnetic core particle is enough so that the surface tension of the vinyl resin sufficiently works. Therefore, the two side surfaces of the concave portion of the porous magnetic core particle effectively function as a bridge, and the concave portion is also coated with the vinyl resin. Furthermore, when the average pore diameter is within the above range, the silicone resin can also be easily and reliably filled inside the porous magnetic core particle.

In the magnetic carrier of the present invention, the surface of the filled core particle is coated with 1.2 to 3.0 parts by mass of the vinyl resin with respect to 100.0 parts by mass of the filled core particle. Since the amount of the coating resin in the above range is a sufficient amount to coat the surface of the filled core particle, the exposure of the silicone resin from the surface of the magnetic carrier particle can be prevented. Therefore, the decrease in glossiness with time as described above can be suppressed. Furthermore, since the irregularities resulting from the porous magnetic core particle remain in the surface of the magnetic carrier particle, sufficient frictional charging is performed to the toner, and the generation of fogging can be suppressed. When the coating amount of the vinyl resin is less than 1.2 parts by mass to 100.0 parts by mass of the filled core particle, coating of the filled core particle is not sufficiently performed, and the decrease in glossiness with time may occur in some cases. In addition, when the coating amount of the vinyl resin is larger than 3.0 parts by mass to 100.0 parts by mass of the filled core particle, the magnetic carrier particle is liable to be melted together in a manufacturing process. In addition, since counter charge is liable to remain after the development, the development properties as the two-component developer are degraded.

The magnetic carrier of the present invention can effectively suppress leakage, fogging, density unevenness, and carrier adhesion by using the filled core particle which includes the porous magnetic core particle and the silicone resin filled therein and also by using the vinyl resin as the coating resin. As for the reason the combination of such resins has excellent results, the present inventors considered as described below.

When the magnetic carrier forms a magnetic brush on a developer support, and a developing bias is applied, a frictional charge imparting property of the magnetic carrier contributes to a frictional charge amount of toner. In addition, the frictional charge imparting property of the magnetic carrier is influenced by the capacitor ability of the coating resin and the resistance of the core particle. The capacitor ability of the coating resin is influenced by the polarity of the coating resin and the thickness thereof, and the capacitor ability is enhanced as the polarity of the coating resin is higher, and as the thickness thereof is larger. In addition, the frictional charge imparting property of the magnetic carrier is enhanced as the capacitor ability of the coating resin is higher.

On the other hand, since accumulated charge is not likely to leak as the resistance of the core particle is higher, the frictional charge imparting property of the magnetic carrier is enhanced. However, if the resistance of the core particle is increased, when a developing bias is applied, the voltage applied to the core particle is increased, and corresponding to this increase, the voltage applied to the coating resin is decreased. In this case, the capacitor ability of the coating resin is proportional to the voltage applied thereto. Therefore, if the resistance of the core particle is high, the voltage applied to the coating resin is decreased, and the capacitor ability thereof is decreased. As a result, the frictional charge imparting property as the magnetic carrier is decreased.

Hence, when a filled core particle formed of a porous magnetic core particle having a low resistance and a silicone resin filled therein is used as the core particle, the decrease of the capacitor ability of the coating resin can be suppressed while leakage of the accumulated charge is suppressed. The above can be performed since the electrostatic capacitance of the vinyl resin used for the coating layer is larger than the electrostatic capacitance of the silicone resin. The reason for this is that when a developing bias is applied to the magnetic carrier, by this difference in electrostatic capacitance, a higher voltage is applied to the vinyl resin film functioning as the coating resin than that to the silicone resin. Furthermore, since the silicone resin film is an insulator, the charge accumulated in the magnetic carrier is unlikely to leak through the core particle. Therefore, when the filled core particle which includes the porous magnetic core particle and the silicone resin filled therein is used as the core particle, and the vinyl resin is used as the coating resin, a magnetic carrier excellent in charge imparting property can be obtained.

In addition, when the magnetic carrier is formed so as to have the structure as described above, the development properties obtained when the magnetic carrier is used as a two-component developer can be made excellent. The porous magnetic core particle has irregularities, and hence, in the magnetic carrier of the present invention, there are places at which the coating resin and the porous magnetic core particle are in direct contact with each other. Hence, in a development process, when the toner flies from the magnetic carrier, the counter charge left on the magnetic carrier is likely to be relieved through the places at which the coating resin and the porous magnetic core particle are in direct contact with each other. As a result, the development properties are improved.

Heretofore, many magnetic carriers in which a surface of a bulk ferrite core particle is coated with a vinyl resin have been proposed. However, in such a structure, since the resistance of the core particle is low, and the charge accumulated by the coating resin is liable to leak, the charge imparting property of the magnetic carrier is low. In addition, when the resistance of the core particle is increased, since the voltage applied to the coating resin is decreased, and the capacitor ability of the coating resin is decreased, as a result, the magnetic carrier has a low charge imparting property. Hence, the magnetic carrier in which the surface of a bulk ferrite core particle is coated with a vinyl resin has not a sufficient charge imparting property, and an effect similar to that of the magnetic carrier of the present invention cannot be obtained. In particular, when an image which consumes a large amount of toner is continuously output, frictional charging to the toner is not sufficiently performed, and the ratio of a reverse polarity toner may be increased in the toner in some cases. Accordingly, a phenomenon in which a reverse polarity toner adheres on an electrostatic latent image support, so-called fogging, is liable to occur.

The magnetic carrier of the present invention preferably has a ratio $S_1$ of 3.0 to 8.0 percent by area, the ratio $S_1$ being a ratio of portions having high luminance derived from the porous magnetic core particle in a backscattered electron image of the magnetic carrier particle taken by a scanning electron microscope at an accelerating voltage of 2.0 kV. $S_1$ is more preferably 4.0 to 7.0 percent by area. $S_1$ is obtained from the following formula (1).

$$S_1 = (\text{total area of portions having high luminance derived from porous magnetic core particle on one magnetic carrier particle/total projection area of the magnetic carrier particle}) \times 100 \quad (1)$$

When $S_1$ is in the above range, it is indicated that the surface of the magnetic carrier is sufficiently coated with the vinyl resin and that irregularities derived from the porous magnetic core particle are present. In addition, it is also indicated that the area of a coating resin film formed between the silicone resin thus filled and the vinyl resin is controlled. Accordingly, sufficient frictional charge can be imparted to the toner.

Method for Manufacturing Porous Magnetic Core Particle

As a material of the porous magnetic core particle, magnetite or ferrite is preferable. Furthermore, since the control of the structure of the porous magnetic core particle and the adjustment of the resistance thereof can be easily performed, the material of the porous magnetic core particle is more preferably ferrite.

Ferrite is a sintered compact represented by the following general formula.

$$(M1_2O)_x(M2O)_y(Fe_2O_3)_z$$

(In the above formula, M1 is a monovalent metal, M2 is a divalent metal, and when $x+y+z=1.0$ holds, $0 \le x \le 0.8$, $0 \le y \le 0.8$, and $0.2 < z < 1.0$ are satisfied.)

In the formula, as M1 and M2, at least one metal atom selected from the group consisting of Li, Fe, Mn, Mg, Sr, Cu, Zn, and Ca is preferably used.

As the ferrite, ferrite containing an Mn element, such as Mn-based ferrite, Mn—Mg-based ferrite, Mn—Mg—Sr-based ferrite, or Li—Mn-based ferrite, is more preferable. In order to preferably form a porous structure and an irregular state of the surface of the porous magnetic core particle, the ferrite containing an Mn element can easily control the growth rate of a ferrite crystal and can also preferably control the resistivity and the magnetic force of the porous magnetic core particle.

Hereinafter, a manufacturing process in the case of using ferrite as the porous magnetic core particle will be described in detail.

Step 1: Weighing and Mixing Step

Raw materials of the ferrite are weighed and are mixed together. The following are mentioned as the ferrite raw materials. For example, they are metal particles, oxides, hydroxides, carbonates, and oxalate of Li, Fe, Mn, Mg, Sr, Cu, Zn, and Ca. Compared to the case of using oxides, when hydroxides and carbonates are used as the raw materials, the pore volume is likely to increase. As a device used for mixing, for example, a ball mill, a planetary mill, a giotto mill, and a vibration mill may be mentioned. Specifically, a ball mill is preferable in view of mixing property. In particular, the ferrite raw materials and balls which are weighed are charged into a ball mill, and grinding and mixing are performed for 0.1 to 20.0 hours.

Step 2: Calcination Step

After the ferrite raw materials thus ground and mixed are formed into pellets using a pressure molding machine or the like, calcination is performed in the air for 0.5 to 5.0 hours at a firing temperature of 700° C. to 1200° C. As a furnace used for the calcination, for example, a burner type firing furnace, a rotary type firing furnace, and an electric furnace may be mentioned.

Step 3: Grinding Step

The calcined ferrite produced in Step 2 is ground by a grinder. The grinder is not particularly limited as long as a desired particle size can be obtained. As the grinder, for example, a crusher, a hammer mill, a ball mill, a bead mill, a planetary mill, and a giotto mill may be mentioned.

When the particle diameter distribution of a finely ground product of the calcined ferrite is controlled, the pore diameter distribution of the porous magnetic core particle and the degree of irregularity of the surface of the magnetic carrier can be controlled. In order to control the particle diameter distribution of the finely ground product of the calcined ferrite, the shape and the material of the ball or the bead used for a ball mill and a bead mill and the operation time of the grinder are preferably controlled. In order to decrease the particle diameter of the calcined ferrite, balls having a high specific gravity may be used, and/or the grinding time may be increased. In addition, in order to widen the particle diameter distribution of the calcined ferrite, balls having a high specific gravity may be used, and/or the grinding time may be decreased. In addition, when several types of calcined ferrite having different particle diameters are mixed together, calcined ferrite having a wide distribution can be obtained. The following may be mentioned by way of example as the material of the ball or the bead. They are soda glass (specific gravity: 2.5 g/cm$^3$), sodaless glass (specific gravity: 2.6 g/cm$^3$), high-density glass (specific gravity: 2.7 g/cm$^3$), quartz (specific gravity: 2.2 g/cm$^3$), titania (specific gravity: 3.9 g/cm$^3$), silicon nitride (specific gravity: 3.2 g/cm$^3$), alumina (specific gravity: 3.6 g/cm$^3$), zirconia (specific gravity: 6.0 g/cm$^3$), steel (specific gravity: 7.9 g/cm$^3$), and stainless steel (specific gravity: 8.0 g/cm$^3$). Among those mentioned above, alumina, zirconia, and stainless steel are preferable since having excellent abrasion resistance. As the ball, a ball having a diameter of 5 to 60 mm is preferably used. In addition, as the bead, a bead having a diameter of 0.03 to 5 mm is preferably used. In addition, when a ball mill or a bead mill is used, compared to a dry type, in a wet type, ground material is not stirred up in the mill, and the grinding efficiency is high. For this reason, the wet type is more preferable than the dry type.

Step 4: Granulation Step

To the finely ground calcined ferrite, a dispersant, water, and a binder are added to form a ferrite slurry. A pore-adjusting agent may also be added, if needed. As the pore-adjusting agent, for example, a foaming agent and resin fine particles may be mentioned. A poly(vinyl alcohol) is used as the binder. In Step 3, when grinding is performed by a wet type, in consideration of the water contained in the ferrite slurry, the materials mentioned above are preferably added.

The obtained ferrite slurry is dried and granulated using a spray drying device in a heating atmosphere at a temperature of 100° C. to 200° C. The spray drying device is not particularly limited as long as a desired particle diameter is obtained. For example, a spray dryer may be used.

Step 5: Firing Step

Next, after debinding of the granulated material thus formed is performed at a temperature of 600° C. to 800° C., firing is performed for 1 to 24 hours at a temperature of 800° C. to 1,300° C. in an atmosphere in which the oxygen concentration is controlled. The heating temperature is more preferably 1,000° C. to 1,200° C. When the crystal growth rate is controlled by shortening a temperature increase time and prolonging a temperature decrease time, a desired porous structure can be obtained. A time of holding a firing temperature is preferably 3 to 5 hours in order to obtain a desired porous structure. Firing of the porous magnetic core particle is advanced by increasing a firing temperature and/or increasing a firing time. In this case, a rotary type electric furnace, a batch type electric furnace, or a continuous type electric furnace may be used. During the firing, an inert gas, such as nitrogen, and/or a reducing gas, such as hydrogen or carbon monoxide, may be fed to control the oxygen concentration. Alternatively, without performing the debinding, firing is performed in the furnace to decompose the binder added in the granulation step, and in a reducing atmosphere formed in the furnace by a gas generated by the decomposition, the oxygen concentration may be controlled. In addition, in the case of using a rotary type electric furnace, firing may be performed many times by changing the atmosphere and/or the firing temperature.

Step 6: Sorting Step

After the fired particles are cracked, if needed, a low magnetic product may be sorted by a magnetic force, and coarse particles and fine particles may also be removed by classification or screening using a screen.

Step 7: Surface Treatment

When an oxide layer treatment is performed on the surface by low temperature heating, if needed, resistance adjustment may be performed. The oxide layer treatment is preferably performed by a heat treatment at 300° C. to 700° C. using a common rotary type electric furnace, batch type electric furnace, or the like. The thickness of the oxide layer formed by this treatment is preferably 0.1 to 5.0 nm. In addition, reduction may be performed before the oxide layer treatment is performed, if needed.

The volume distribution base 50% particle diameter (D50) of the porous magnetic core particle thus obtained is preferably 18.0 to 68.0 μm. If D50 of the porous magnetic core particle is within the above range, the frictional charge imparting property to the toner can be improved, the image quality of a halftone portion can be satisfied, and suppression of fogging and prevention of carrier adhesion can be performed.

Since the developing property can be improved, the porous magnetic core particle preferably has a resistivity of $5.0\times10^6$ to $5.0\times10^8$ ohm·cm at an electric field strength of 300 V/cm measured by a resistivity measurement method which will be described late.

Method for Manufacturing Filled Core Particle

As a method for filling the silicone resin in the pores of the porous magnetic core particle, for example, a method may be mentioned in which after the silicone resin is dissolved in a solvent and is then added to the pores of the porous magnetic core particle, the solvent is removed. Any solvent may be used as long as it can dissolve the silicone resin. As an organic solvent, for example, toluene, xylene, cellosolve butyl acetate, methyl ethyl ketone, methyl isobutyl ketone, and methanol may be mentioned. As a method for filling the resin in the pores of the porous magnetic core particle, a coating method, such as a dipping method, a spray method, a brushing method, and a fluidized bed method, may be performed, and subsequently, the solvent is evaporated.

As the dipping method, a method is preferable in which a silicone resin solution containing the solvent and the silicone resin dissolved therein is filled in the pores of the porous magnetic core particle in a reduced-pressure atmosphere, and the solvent is then removed by deaeration and/or heating. The impregnating ability of the silicone resin to the pores of the porous magnetic core particle can be controlled by controlling a solvent removal rate using a deaeration rate and/or a heating temperature. The degree of reduced pressure is preferably $1.30\times10^3$ to $9.30\times10^4$ Pa. When the pressure is higher than $9.30\times10^4$ Pa, a reduced-pressure effect is not obtained, and when the pressure is lower than $1.30\times10^3$ Pa, since the resin solution is liable to be boiled in the filling step, portions which are not filled with the resin may remain in some cases.

It is preferable that the step of filling the silicone resin be repeatedly performed a plurality of times. Since the silicone resin can be filled by one filling step, the step of filling the silicone resin is not always repeated a plurality to times. However, depending on the type of silicone resin, when a large amount of resin is filled at a time, coalescing particles may be formed in some cases. Since the coalescing particles have a weak mechanical strength, the resin is easily peeled off by mixing and stirring performed in a developing machine, and as a result, the surface of the filled core particle is exposed. Accordingly, the electric resistance of the magnetic carrier is decreased, and leakage may occur in development in some cases. On the other hand, when the filling of the resin is repeatedly performed a plurality of times, the filling can be appropriately performed while the formation of coalescing particles is prevented.

After being filled in the particle, the silicone resin thus filled is heated by one of various types of methods, if needed, so as to be tightly adhered to the porous magnetic core particle. As a heating method, either an external heating method or an internal heating method may be used, and firing by a stationary or a movable electric furnace, a rotary electric furnace, a burner furnace, and a microwave furnace may be mentioned. Although the heating temperature changes in accordance with the type of silicone resin, when the temperature is increased so as to sufficiently perform curing, a magnetic carrier having a high impact resistance can be obtained. In order to prevent oxidation, the treatment is preferably performed in an inert gas stream of nitrogen or the like.

Since the cumulative pore volume of the filled core particle used in the present invention is 3.0 to 15.0 $mm^3/g$, the amount of the silicone resin to be filled is preferably 60 to 90 percent by volume with respect to the pore volume of the porous magnetic core particle. In order to improve the coating property of the vinyl resin, the amount is more preferably 70 to 80 percent by volume. In addition, since the cumulative pore volume of the porous magnetic core particle used in the present invention is 35.0 to 95.0 $mm^3/g$, the amount of the silicone resin to be filled is preferably 3.0 to 10.0 parts by mass with respect to 100 parts by mass of the porous magnetic core particle. The amount is more preferably 6.0 to 8.0 parts by mass.

A resin solid content in the silicone resin solution is preferably 6 to 25 percent by mass. If the resin solid content in the silicone resin solution is in the above range, since the handling property of the viscosity of the resin solution is superior, the filling property in the pores is also superior, and the time for removing the solvent will not take a long time.

Although the type of silicone resin to be filled in the pores of the porous magnetic core particle is not particularly limited, a silicone resin having high impregnating ability is preferable. When a silicone resin having high impregnating ability is used, since the porous magnetic core particle is filled from the insides thereof, pores in the vicinity of the surface of the filled core particle remain. Since the surface of the filled core particle has an irregular shape thereby, the coating property by the vinyl resin is improved as described above.

From the point described above, in the silicone resin, the average number of organic groups R bonded to one Si atom (R/Si ratio) is preferably 1.30 to 1.50. If the R/Si ratio is within the above range, the impregnating ability of the silicone resin is high, the resin is filled in the porous magnetic core particle from the inside thereof, and the coating property of the vinyl resin can be improved. In this case, the organic group R represents a chain hydrocarbon or a cyclic hydrocarbon having a ring structure. The reason the coating property of the vinyl resin is improved is that when the R/Si ratio is within the above range, since the silicone resin contains an appropriate amount of silanol groups, curing properties of the silicone resin and compatibility thereof with the vinyl resin can be simultaneously obtained. In general, if the R/Si ratio is decreased, the amount of silanol groups is increased, and the curing properties of the silicone resin are enhanced. In addition, if the R/Si ratio is increased, the amount of silanol groups is decreased, and the compatibility with the vinyl resin is decreased. However, when the cumulative pore volume of the filled core particle is not in an appropriate range, even if the compatibility of the silicone resin with the vinyl resin is increased by adjustment of the R/Si ratio, the filled core particle cannot be sufficiently coated with the vinyl resin.

As the silicone resin, the following may be mentioned as a commercially available product. For example, KR251 and KR255 manufactured by Shin-Etsu Chemical Co., Ltd., and SR2440 and SR2441 manufactured by Dow Corning Toray Co., Ltd may be mentioned.

When the silicone resin is filled, a silane coupling agent is contained in a solution in which the silicone resin is dissolved. The silane coupling agent has good compatibility with the silicone resin, and by using the silane coupling agent, the wettability and the adhesion between the porous magnetic core particle and the silicone resin are further enhanced. Hence, the silicone resin is filled in the porous magnetic core particle from the inside thereof, and the pores are allowed to appropriately remain in the vicinity of the surface of the filled core particle. As a result, since the surface of the filled core particle has an irregular shape, the coating property by the vinyl resin is improved as described above.

Although the silane coupling agent to be used is not particularly limited, an aminosilane coupling agent is particularly preferable since the compatibility with the vinyl resin is improved by its functional group. The reason the aminosilane coupling agent improves the wettability and the adhesion between the porous magnetic core particle and the silicone resin and also improves the compatibility with the vinyl resin is believed as follows. The aminosilane coupling agent has a portion to react with an inorganic substance and a portion to react with an organic substance, and in general, it is believed that an alkoxy group reacts with an inorganic substance and a functional group having an amino group reacts with an organic substance. Hence, it is believed that the alkoxy group of the aminosilane coupling agent reacts with a portion of the porous magnetic core particle to improve the wettability and the adhesion, and that since the functional group having an amino group is oriented at a silicone resin side, the compatibility with the vinyl resin is improved.

The amount of the silane coupling agent to be added is preferably 1.0 to 20.0 parts by mass to 100 parts by mass of the silicone resin. The amount is more preferably 5.0 to 10.0 parts by mass.

The filled core particle used for the present invention preferably has a volume distribution base 50% particle diameter (D50) of 19.0 to 69.0 μm. If D50 of the filled core particle is in the above range, the carrier adhesion and toner spent can be suppressed.

The filled core particle used for the present invention preferably has a resistivity of $1.0\times10^7$ to $1.0\times10^9$ ohm·cm at an electric field strength of 1,000 V/cm measured by a resistivity measurement method which will be described later. If the resistivity of the filled core particle at an electric field strength of 1,000 V/cm is in the above range, an appropriate amount of the resin is filled therein, and for example, the generation of leakage is suppressed, so that preferable development properties can be obtained.

Method for Manufacturing Magnetic Carrier

Although a method for coating the surface of the filled core particle with the vinyl resin is not particularly limited, a coating method, such as a dipping method, a spray method, a brushing method, a dry method, and a fluidized bed method, may be mentioned. Among those mentioned above, in order to use the features of a low-resistance porous magnetic core particle, a dip coating which can control the ratio between a thin coating layer portion and a thick coating layer portion is more preferable.

A method similar to that of the filling step may be used for preparation of a vinyl resin solution used for coating. In order to control the granulation in a coating step, the resin concentration in the resin solution used for coating, the temperature inside a device used for coating, the temperature and the degree of reduced pressure when the solvent is removed, and the number of resin coating steps are adjusted.

Although the vinyl resin used for the coating layer is not particularly limited, a copolymer of a vinyl monomer having a cyclic hydrocarbon group in its molecular structure and another vinyl monomer is preferable. By using this vinyl resin for coating, a decrease in charge amount under high humidity and high temperature conditions can be suppressed. The reason for this is believed as follows. When the surface of the filled core particle is coated with the vinyl resin, a step of mixing a resin solution containing the vinyl resin dissolved in an organic solvent and the filled core particle and a step of removing the solvent are performed. In this case, it is believed that the solvent is removed while a cyclic hydrocarbon group is oriented on the surface of the coating resin layer, and the coating resin layer is formed so that a cyclic hydrocarbon group having a high hydrophobic property is oriented on the surface of the magnetic carrier after the solvent is removed.

As a particular example of the cyclic hydrocarbon group, a cyclic hydrocarbon group having 3 to 10 carbon atoms may be mentioned. Specifically, for example, there may be mentioned a cyclohexyl group, a cyclopentyl group, an adamantyl group, a cyclopropyl group, a cyclobutyl group, a cycloheptyl group, a cyclooctyl group, a cyclononyl group, a cyclodecyl group, an isobornyl group, a norbornyl group, and a bornyl group may be mentioned. Among those mentioned above, a cyclohexyl group, a cyclopentyl group, and an adamantyl group are preferable. In addition, since having high adhesion with the filled core particle because of the structural stability, a cyclohexyl group is particularly preferable.

In addition, in order to adjust the glass transition temperature (Tg), one or more other monomers may be further contained as a constituent component of the vinyl resin. As the other monomers used as the constituent component of the vinyl resin, known monomers may be used, and for example, the following may be mentioned. For example, they may be styrene, ethylene, propylene, butylene, butadiene, vinyl chloride, vinylidene chloride, vinyl acetate, methyl methacrylate, ethyl methacrylate, propyl methacrylate, vinyl methyl ether, vinyl ethyl ether, and vinyl methyl ketone.

Since the wettability with the porous magnetic core particle is further improved, and a uniform vinyl coating layer is formed, the vinyl resin used for the coating layer is preferably a graft polymer. In order to obtain a graft polymer, for example, there may be mentioned a method for performing graft polymerization after a main chain is formed and a copolymerization method using a macromonomer as a monomer. Among those mentioned above, the copolymerization method using a macromonomer is preferable since the molecular weight of a branch chain can be easily controlled.

Although the macromonomer to be used is not particularly limited, since the wettability with the porous magnetic core particle is further improved, a methyl methacrylate macromonomer is preferable. The reason for this is that while the cyclic hydrocarbon group is oriented on the surface of the coating resin layer, the macromonomer having significantly different hydrophobic properties is oriented on the filled core particle. In addition, it is also believed that since the macromonomer has an oligomer molecule having a reactive functional group at the end of its polymer chain, the wettability with the porous magnetic core particle is enhanced.

The amount of a branch chain derived from the macromonomer used for polymerization is preferably 10 to 50 parts by mass and more preferably 20 to 40 parts by mass with respect to 100 parts by mass of a main chain of the vinyl resin.

In addition, particles having conductivity, and/or particles or a material having charge controllability may also be used as additives contained in the coating resin. As the particles having conductivity, for example, carbon black, magnetite, graphite, zinc oxide, and tin oxide may be mentioned. In order to adjust the resistance of the magnetic carrier, the addition amount of the particles having conductivity to 100 parts by mass of the coating resin is preferably 0.1 to 10.0 parts by mass. As the particles having charge controllability, for example, there may be mentioned organometallic complex particles, organic metal salt particles, chelate compound particles, monoazo metal complex particles, acetylacetone metal complex particles, hydroxycarboxylic acid metal complex particles, polycarboxylic acid metal complex particles, polyol metal complex particles, poly(methyl methacrylic) resin particles, polystyrene resin particles, melamine resin particles, phenol resin particles, nylon resin particles, silica particles, titanium oxide particles, and alumina particles. In order to adjust the frictional charge amount, the addition amount of the particles having charge controllability to 100 parts by mass of the coating resin is preferably 0.5 to 50.0 parts by mass.

The magnetic carrier of the present invention preferably has a volume distribution base 50% particle diameter (D50) of 20.0 to 70.0 μm since the magnetic carrier suppresses the carrier adhesion and the toner spent and can be stably used even for a long time.

Since the developing property can be enhanced, the magnetic carrier of the present invention preferably has a resistivity of $5.0\times10^7$ to $5.0\times10^9$ ohm·cm at an electric field strength of 1,000 V/cm by a resistivity measurement method which will be described later.

Method for Manufacturing Toner

Next, the toner contained in the two-component developer together with the magnetic carrier will be described.

The following methods may be mentioned by way of example as a method for manufacturing toner particles used for the toner. For example, there may be mentioned a grinding method in which after a binder resin, a coloring agent, and a wax are melted and mixed together, the mixture thus formed is cooled, and grinding and classification thereof are then carried out; a suspension granulation method in which a solution containing a binder resin and a coloring agent dissolved or dispersed in a solvent is introduced into an aqueous medium for suspension granulation, and the solvent is then removed to obtain toner particles; a suspension polymerization method in which after a monomer composition containing a coloring agent and the like dissolved or dispersed in a monomer is dispersed in a continuous layer (such as an aqueous phase) containing a dispersion stabilizer, a polymerization reaction is performed to produce toner particles; a dispersion polymerization method in which a polymer dispersant is dissolved in an aqueous organic solvent, and when a monomer is polymerized, particles insoluble in the solvent are produced to obtain toner particles; an emulsion polymerization in which direct polymerization is performed in the presence of an aqueous polar polymerization initiator to produce toner particles; and an emulsion aggregation method in which toner particles are obtained at least through a step of forming fine particle aggregates by aggregating polymeric fine particles and coloring fine particles and an aging step of welding fine particles in the fine particle aggregates together. When the toner is produced by a grinding method, after the grinding or after the grinding and classification, if the surface of the toner is modified by a mechanical and/or a thermal treatment, reduction in small size particles can be performed.

As the binder resin contained in the toner, the following may be mentioned by way of example. For example, there may be mentioned a polyester, a polystyrene; a polymer of a styrene derivative, such as a poly-p-chlorostyrene or a polyvinyl toluene; a styrene copolymer, such as a styrene-p-chlorostyrene copolymer, a styrene-vinyltoluene copolymer, a styrene-vinylnaphthalene copolymer, a styrene-acrylic ester copolymer, a styrene-methacrylic ester copolymer, a styrene-α-chloro-methyl methacrylate copolymer, a styrene-acrylonitrile copolymer, a styrene-vinyl methyl ketone copolymer, a styrene-butadiene copolymer, a styrene-isoprene copolymer, and a styrene-acrylonitrile-indene copolymer; a poly(vinyl chloride), a phenol resin, a modified phenol resin, a maleic resin, an acrylic resin, a methacrylic resin, a poly(vinyl acetate), a silicone resin; a polyester rein having a monomer as a structural unit selected from the group consisting of an aliphatic polyhydric alcohol, an aliphatic dicarboxylic acid, an aromatic dicarboxylic acid, an aromatic dialcohol, and an diphenol; a polyurethane resin, a polyamide resin, a polyvinyl butyral, a terpene resin, a coumarone indene resin, a petroleum resin, and a hybrid resin having a polyester unit and a vinyl polymeric unit.

In order to simultaneously satisfy storage stability and low-temperature fixability of the toner, the binder resin preferably has a peak molecular weight (Mp) of 2,000 to 50,000 of the molecular weight distribution, a number average molecular weight (Mn) of 1,500 to 30,000, and a weight average molecular weight (Mn) of 2,000 to 1,000,000, which are measured by a gel permeation chromatography (GPC), and a glass transition point (Tg) of 40° C. to 80° C.

With respect to 100 parts by mass of the binder resin, 0.5 to 20.0 parts by mass of the wax is preferably used since an image having high glossiness can be provided. In addition, a peak temperature of the maximum endothermic peak of the wax is preferably 45° C. to 140° C. The reason for this is that the storage stability and anti-hot offset property of the toner can be simultaneously obtained.

As the wax, the following may be mentioned. For example, there may be mentioned a hydrocarbon wax, such as a low molecular weight polyethylene, a low molecular weight polypropylene, an alkylene copolymer, a microcrystalline wax, a paraffin wax, or a Fischer-Tropsch wax; an oxide of a hydrocarbon wax, such as an oxidized polyethylene wax, or a block copolymer thereof; a wax containing a fatty acid ester as a primary component, such as a carnauba wax, a behenic acid behenyl ester wax, or a montanic acid ester wax; and a partially or fully deoxidized fatty acid ester, such as a deoxidized carnauba wax. Among those mentioned above, a hydrocarbon wax such as a Fischer-Tropsch wax is preferable since an image having high glossiness can be provided.

As the coloring agent contained in the toner, for example, the following may be mentioned.

As a black coloring agent, for example, carbon black, a magnetic substance, and an agent prepared by using a yellow coloring agent, a magenta coloring agent, and a cyan coloring agent may be mentioned. As a magenta coloring agent, for example, a condensed azo compound, a diketo pyrrolo pyrrole compound, anthraquinone, a quinacridone compound, a basic dye lake compound, a naphthol compound, a benzimidazolone compound, a thioindigo compound, and a perylene compound may be mentioned. As a cyan coloring agent, for example, C. I. Pigment Blues 1, 2, 3, 7, 15:2, 15:3, 15:4, 16, 17, 60, 62, and 66; C.I. Bat Blue-6, C.I. Acid Blue-45, and a phthalocyanine pigment in which a phthalocyanine skeleton is substituted with 1 to 5 phthalimidemethyl groups may be mentioned. As a yellow coloring agent, for example, a condensed azo compound, an isoindolinone compound, an anthraquinone compound, an azo metal compound, a methine compound, and an allylamide compound may be mentioned. Although a pigment may be used alone as the coloring agent, since the color definition can be improved by using a dye and a pigment together, the use thereof in combination is preferable in view of full-color image quality.

Except for the case of using a magnetic substance, the amount of the coloring agent to be used is preferably 0.1 to 30.0 parts by mass with respect to 100 parts by mass of the binder resin and more preferably 0.5 to 20.0 parts by mass.

The toner may contain a charge controlling agent, if needed. As the charge controlling agent contained in the toner, although a known agent may be used, in particular, a metal compound of an aromatic carboxylic acid which is colorless, which has a fast charging rate of the toner, and which can stably maintain a predetermined charge amount is preferable. The charge controlling agent may be internally or externally added to the toner particles. The addition amount of the charge controlling agent is preferably 0.2 to 10 parts by mass with respect to 100 parts by mass of the binder resin.

An external additive is preferably added to the toner for fluidity improvement. As the external additive, an inorganic fine powder, such as silica, titanium oxide, or aluminum oxide, is preferable. The inorganic fine powder is preferably hydrophobized by a hydrophobizing agent, such as a silane compound, a silicone oil, or a mixture thereof. With respect to 100 parts by mass of the toner particles, 0.1 to 5.0 parts by mass of the external additive is preferably used. For mixing between the toner particles and the external additive, a known mixer, such as a Henschel mixer, may be used.

A toner manufacturing procedure by a grinding method will be described.

In a raw material mixing step, as materials forming the toner particles, for example, predetermined amounts of the binder resin, the coloring agent, and the wax are weighed, blended, and mixed together with other components, such as the charge controlling agent, if needed. As examples of a mixing device, a double cone mixer, a V type mixer, a drum type mixer, a super mixer, a Henschel mixer, a Nauta mixer, and a Mechano hybrid mixer (manufactured by Mitsui Mining Co., Ltd.) may be mentioned.

Next, the mixed materials are melted and kneaded so that the coloring agent and the like are dispersed in the binder resin. In this melt kneading step, a batch type kneading machine, such as a pressure kneader or a Banbury mixer, or a continuous kneading machine can be used, and a monoaxial or a biaxial extruder has been mainly used because of the advantage in continuous production. For example, there may be mentioned a KTK type biaxial extruder (manufactured by Kobe Steel, Ltd.), a TEM type biaxial extruder (manufactured by Toshiba Machine Co., Ltd.), a PCM kneading machine (manufactured by Ikegai Co., Ltd.), a biaxial extruder (manufactured by KCK Co., Ltd.), a co-kneader (manufactured by Buss Co., Ltd.), and a kneadex (manufactured by Mitsui Mining Co., Ltd.).

The colored resin composition obtained by the melt kneading may be further processed by rolling using a two-roll method and cooled with water in a cooling step.

Subsequently, the resin composition thus cooled is ground in a grinding step to have a desired particle diameter. In the grinding step, after coarse grinding is performed by a grinder, such as a crusher, a hammer mill, or a feather mill, pulverizing is further performed by a pulverizing mill, such as a Kryptron System (manufactured by Kawasaki Heavy Industries, Ltd.), a Super Rotor (manufactured by Nisshin Engineering Inc.)), a Turbo Mill (manufactured by Turbo Corporation), or an air jet type pulverizer.

Next, if needed, classification is performed using a classifier or a screening machine, such as an inertial classification type Elbow-Jet (manufactured by Nittetsu Mining Co., Ltd.), a centrifugal classification type Turboplex (manufactured by Hosokawa Micron Corporation), a TSP separator (manufactured by Hosokawa Micron Corporation), and a Faculty (manufactured by Hosokawa Micron CORP.), so that the toner particles are obtained.

In addition, if needed, after the grinding, a surface modification treatment of the toner particles, such as a spheronization treatment, may be performed using a Hybridization System (manufactured by Nara Machinery Co., Ltd.), a Mechanofusion System (manufactured by Hosokawa Micron Corporation), a Faculty (manufactured by Hosokawa Micron Corporation), and a Meteo Rainbow MR Type (manufactured by Nippon Pneumatic Mfg. Co., Ltd).

As the two-component developer, the mixing ratio of the toner to 100 parts by mass of the magnetic carrier is preferably set to 2 to 15 parts by mass and more preferably set to 4 to 12 parts by mass. When the mixing ratio is set in the above range, scattering of the toner can be reduced, and the frictional charge amount is stabilized over a long period of time.

Hereinafter, measurement of the respective physical properties relating to the present invention will be described.

Method for Measuring Volume Distribution Base 50% Particle Diameter (D50) of Magnetic Carrier, Filled Core Particle, and Porous Magnetic Core Particle Measurement of particle size distribution was performed by a laser diffraction/scattering type particle size distribution measuring apparatus "Microtrack MT3300EX" (manufactured by Nikkiso Co., Ltd.).

For the measurement of the volume distribution base 50% particle diameter (D50), a sample feeding machine for dry measurement "One-shot Dry-type Sample Conditioner Turbotrac" (manufactured by Nikkiso Co., Ltd.) was fitted to the above measuring apparatus. As the feeding conditions of Turbotrac, a dust collector was used as a vacuum source, the air volume was set to approximately 33 liters/sec, and the pressure was set to approximately 17 kPa. The control is automatically performed on software. As the particle diameter, the 50% particle diameter (D50) which is the cumulative value on the volume basis is obtained. The control and the analysis are performed using the attached software (version 10.3.3-202D). The measurement conditions are shown below.

Figure 1B:
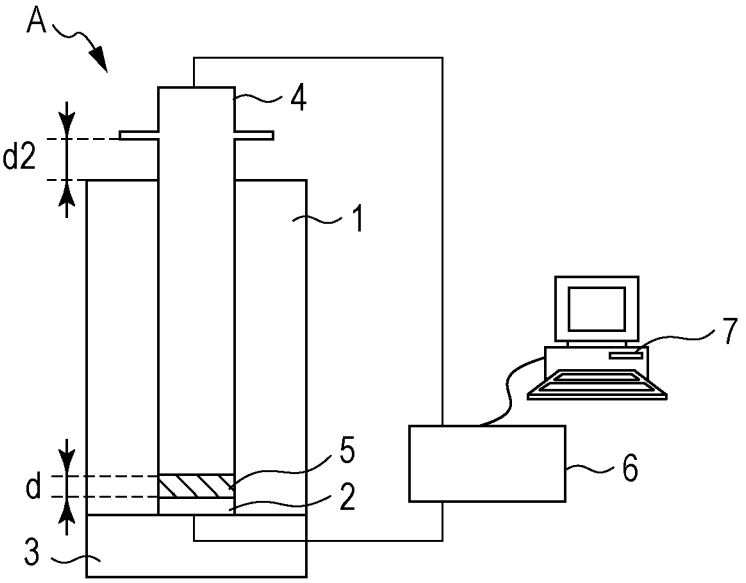

SetZero time: 10 seconds
Measuring time: 10 seconds
Number of measurements: one time
Particle refractive index: 1.81
Particle shape: non-spherical form
Measurement upper limit: 1,408 μm
Measurement lower limit: 0.243 μm
Measurement environment: approximately 23° C./50% RH Measurement of Resistivity of Magnetic Carrier and Filled Core Particle at Electric Field Strength of 1,000 V/cm and Resistivity of Porous Magnetic Core Particle at Electric Field Strength of 300 V/cm The resistivity of the magnetic carrier and that of the filled core particle, each at an electric field strength of 1,000 V/cm, and the resistivity of the porous magnetic core particle at an electric field strength of 300 V/cm are measured using a measuring apparatus schematically shown in FIGS. 1A and 1B.

A resistance measurement cell A includes a cylindrical PTFE resin container 1 in which a hole having a cross-section area of 2.4 $cm^2$ is formed, a lower electrode (formed from stainless steel) 2, a pedestal (formed from a PTFE resin) 3, and an upper electrode (formed from stainless steel) 4. The cylindrical PTFE resin container 1 is placed on the pedestal 3, a sample (the magnetic carrier, the filled core particle, or the porous magnetic core particle) 5 is filled so that the thickness thereof is approximately 1 mm, the upper electrode 4 is placed on the sample 5 thus filled, and the thickness of the sample is measured. As shown in FIG. 1A, if the space is represented by d1 when the sample is not provided, and the space is represented by d2 when the sample is filled to have a thickness of approximately 1 mm, the thickness d of the sample is computed by the following formula.

$$d=d2-d1$$

In this case, it is important to appropriately change the mass of the sample so that the thickness thereof is set to 0.95 to 1.04 mm.

The resistivity of the magnetic carrier and that of the porous magnetic core particle can be obtained when a current is measured by applying a direct current voltage between the electrodes. For the measurement, an electrometer 6 (Keithley 6517A, manufactured by Keithley Instruments Inc.) and a computer 7 for control are used.

Control is performed by a control system manufactured by National Instruments Corporation for the control computer and software using control software (LabVEIW manufactured by National Instruments Corporation). As measurement conditions, a contact area S of 2.4 $cm^2$, which is a contact area between the sample and the electrode, and an actually measured thickness, which is adjusted between 0.95 to 1.04 mm, are input. In addition, the load of the upper electrode and the maximum application voltage are set to 270 g and 1,000 V, respectively.

The condition for applying the voltage is as described below. Screening in which the voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), 256 V ($2^8$ V), 512 V ($2^9$ V) and 1,000 V are each applied for one second is performed using an automatic range function of the electrometer by using an IEEE-488 interface for the control between the control computer and the electrometer. In this case, the electrometer determines whether the voltage can be applied up to 1,000 V (for example, when the sample thickness is 1.00 mm, the electric field strength is 10,000 V/cm), and when an overcurrent flows, "VOLTAGE SOURCE OPERATE" turns on and off. Then, the application voltage is decreased, and the applicable voltages are further screened, and the maximum value of the application voltage is automatically determined. Subsequently, the main measurement is performed. The determined maximum value of the applicable voltage is divided into five, and from the current values measured after the respective voltages are maintained for 30 seconds, the resistance values are obtained. For example, when the maximum application voltage is 1,000 V, the voltage is applied in such a way that the voltage is increased and is then decreased by 200 V at each step, which is one fifth of the maximum application voltage. That is, the steps are performed such that 200 V (first step), 400 V (second step), 600 V (third step), 800 V (fourth step), 1,000 V (fifth step), 1,000 V (sixth step), 800 V (seventh step), 600 V (eighth step), 400 V (ninth step), and 200 V (tenth step) are applied in this order, and at each step, the resistance value is obtained from the current value measured after the voltage at each step is maintained for 30 seconds.

In the case of the magnetic carrier used in Example 1, DC voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), and 256 V ($2^8$ V) were each applied to the magnetic carrier for one second at the time of the screening, and the indication of "VOLTAGE SOURCE OPERATE" lighted up to 128 V, and the indication of "VOLTAGE SOURCE OPERATE" turned on and off at 256 V. Next, the indication turned on at a DC voltage of 181 V ($2^{7.5}$ V), the indication turned on and off at a DC voltage of 215 V (approximately $2^{7.7}$ V), and when the maximum applicable voltage was converged, the indication turned on at a DC voltage of 197 V ($2^{7.6}$ V). As a result, the maximum application voltage was 197 V ($2^{7.6}$V). DC voltages of 39.4 V (first step) which is 1/5 of 197 V, 78.8 V (second step) which is 2/5 of 197 V, 118.2 V (third step) which is 3/5 of 197 V, 157.6 V (fourth step) which is 4/5 of 197 V, 197 V (fifth step) which is 5/5 of 197 V, 197 V (sixth step) which is 5/5 of 197 V, 157.6 V (seventh step) which is 4/5 of 197 V, 118.2 V (eighth step) which is 3/5 of 197 V, 78.8 V (ninth step) which is 2/5 of 197 V, 39.4 V (tenth step) which is 1/5 of 197 V are applied in this order. By processing the current values thus obtained using a computer, the electric field strength and the resistivity are computed from a sample thickness of 1.04 mm and the electrode area and are then plotted in a graph. In this case, five points are plotted from the maximum application voltage in a descending order. Subsequently, the resistivity at an electric field strength of 1,000 V/cm or 300 V/cm is read.

The resistivity and the electric field strength can be obtained from the following formulas.

$$\text{Resistivity(ohm·cm)}=(\text{application voltage(V)}/\text{measured current(A)})\times S(\text{cm}^2)/d(\text{cm})$$

$$\text{Electric field strength(V/cm)}=\text{application voltage (V)}/d(\text{cm})$$

Measurement of Cumulative Pore Volume and Average Pore Diameter of Porous Magnetic Core Particle and Filled Core Particle The cumulative pore volume of the porous magnetic core particle and that of the filled core particle are each measured by a mercury intrusion method. The measurement principle is as follows. In this measurement, the pressure applied to mercury is changed, and the amount of mercury which is intruded into the pore is measured. The conditions in which mercury can intrude into a pore can be represented by $PD=-4\sigma\cdot\cos\theta$ due to equilibrium of forces when the pressure, the pore diameter, the contact angle of mercury, and the surface tension thereof are represented by P, D, θ, and σ, respectively. When the contact angle and the surface tension are each regarded as a constant, the pressure P is in inverse proportion to the pore diameter D into which mercury can intrude. Hence, the horizontal axis P of a P-V curve obtained by measuring the liquid volume V which is intruded into the pore at a pressure P by changing the pressure is simply replaced with the pore diameter from the above formula to obtain the pore distribution, and the differential pore volume in a pore diameter range of 0.1 to 3.0 μm is integrated so that the pore volume (coated area in FIG. 2B) is computed. As a measurement apparatus, for example, a full automatic multifunctional mercury porosimeter, PoreMaster series/PoreMaster-GT series manufactured by Yuasa-Ionics Company, Ltd. and an automatic porosimeter, AutoPore IV9500 series manufactured by Shimadzu Corp. may be used. In this application, the measurement was performed under the following conditions and the procedure using an AutoPore IV9520 manufactured by Shimadzu Corp.

Measurement conditions: "Measurement environment: 20° C.", "Measurement cell; sample volume: 5 $cm^3$, intrusion volume: 1.1 $cm^3$, application: powder measurement", "Measurement range: 2.0 psia (13.8 kPa) to 59,989.6 psia (413.7 Mpa)", "Measurement step: 80 steps (regular intervals are set when the pore diameter is represented in logarithm)", "Intrusion volume: adjusted in a range of 25% to 70%", "Low pressure parameter; evacuation pressure: 50 μmHg, evacuation time: 5.0 min, mercury intrusion pressure: 2.0 psia (13.8 kPa), equilibrium time: 5 seconds", "High pressure parameter; equilibrium time: 5 seconds", "Mercury parameter; advancing contact angle: 130.0 degrees, receding contact angle: 130.0 degrees, surface tension: 485.0 mN/m (485.0 dynes/cm), mercury density: 13.5335 g/mL".

Measurement Procedure (1) Approximately 1.0 g of the porous magnetic core particle or the filled core particle is weighed and is then charged in a sample cell. In addition, the weighed value is input.

(2) Measurement in a range of 2.0 psia (13.8 kPa) to 45.8 psia (315.6 kPa) in a low pressure portion is performed.

(3) Measurement in a range of 45.9 psia (316.3 kPa) to 59,989.6 psia (413.6 Mpa) in a high pressure portion is performed.

(4) The pore distribution and the average pore diameter are obtained by calculation from the mercury intrusion pressure and the volume of intruded mercury. The average pore diameter is a value analyzed and computed with attached software and is a value of the median pore diameter (volume basis) obtained when the pore diameter is specified in a pore diameter range of 0.1 to 3.0 μm.

Figure 2A:
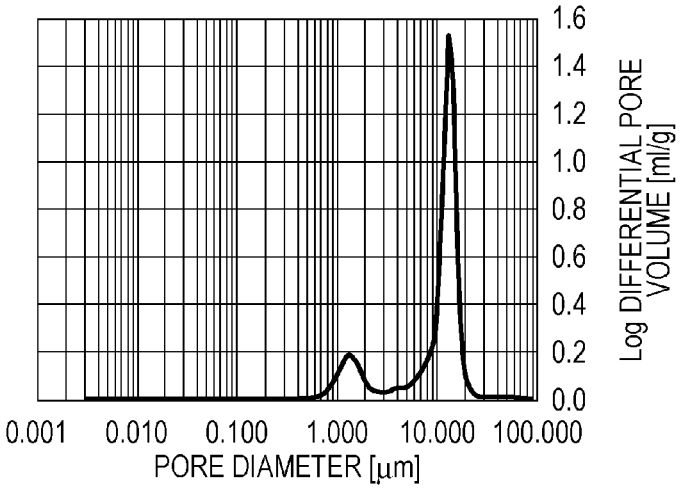
FIG. 2A is a graph showing one example of a pore distribution of a porous magnetic core particle measured by a mercury intrusion method.
Figure 2B:
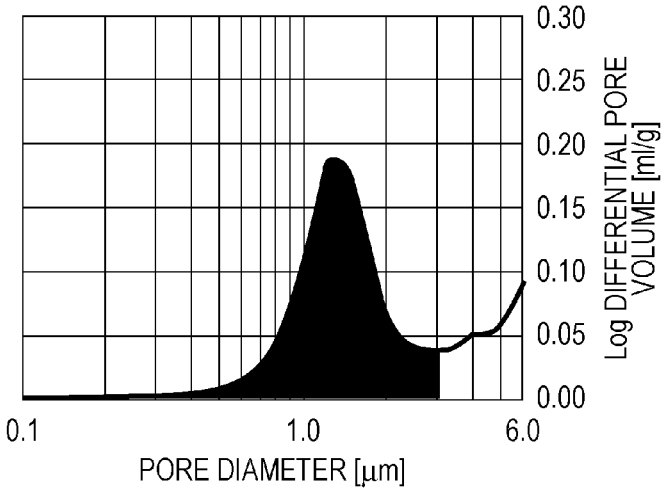
FIG. 2B is a graph showing an enlarged region of the pore distribution in a pore diameter range of 0.1 to 6.0 μm.
Figure 2C:
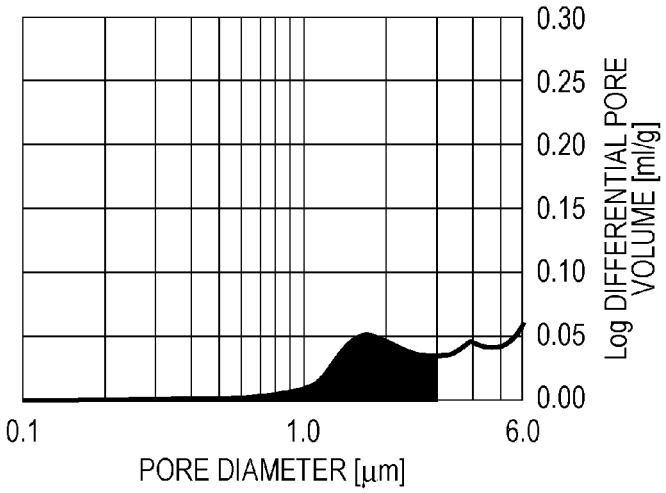
FIG. 2C is a graph showing one example in which in a pore distribution of a filled core particle measured by a mercury intrusion method, a pore diameter region of 0.1 to 6.0 μm is enlarged.

The above (2), (3), and (4) are automatically performed by attached software. Examples of the pore distribution measured as described above are shown in FIGS. 2A to 2C. FIG. 2A shows the pore distribution of the porous magnetic core particle in all the measurement regions, and FIG. 2B shows the pore distribution in a pore diameter range of 0.1 μm to 6.0 μm, which is a part of that shown in FIG. 2A. The cumulative pore volume in a pore diameter range of 0.1 to 3.0 μm is computed by integrating a Log differential pore volume in a pore diameter range of 0.1 to 3.0 μm using attached software. The average pore diameter is also computed. In FIG. 2B, the pore volume in a pore diameter range of 0.1 μm to 3.0 μm is represented by a black area. FIG. 2C shows the pore distribution of the filled core particle in a pore diameter range of 0.1 μm to 6.0 μm. In FIG. 2C, the pore volume in a pore diameter range of 0.1 μm to 3.0 μm is represented by a black area.

Ratio $S_1$ of Portions Having High Luminance Derived from Porous Magnetic Core Particle The ratio $S_1$ of portions having high luminance derived from the porous magnetic core particle on the surface of the magnetic carrier particle can be obtained by observation of a backscattered electron image using a scanning electron microscope, followed by performing image processing.

Measurement of the ratio $S_1$ of portions having high luminance derived from the porous magnetic core particle on the surface of the magnetic carrier particle is performed using a scanning electron microscope (SEM), S-4800 (manufactured by Hitachi, Ltd.). The area ratio of the portions derived from the porous magnetic core particle is computed by image processing of an image obtained by visualizing primarily backscattered electrons at an accelerating voltage of 2.0 kV.

In particular, the magnetic carrier particles are fixed on a sample table for electron microscope observation by a carbon tape so as to form a single layer, and without performing vacuum evaporation by platinum, observation is performed under the following conditions by a scanning electron microscope S-4800 (manufactured by Hitachi, Ltd.). Observation is performed after the flushing operation is performed.

Figure 3A:
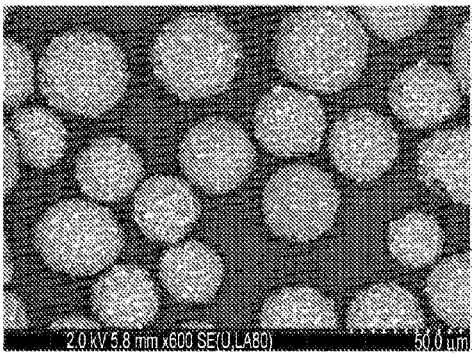
FIGS. 3A to 3E are each a photo illustrating image processing performed when portions having high luminance are obtained from a SEM image of a magnetic carrier.

Signal Name: SE (U, LA80)
Accelerating Voltage: 2,000 Volts
Emission Current: 10,000 nA
Working Distance: 6000 μm
Lens Mode: High
Condenser 1: 5
Scan Speed Slow 4 (40 seconds)
Magnification: 600
Data Size: 1,280×960
Color Mode: Gray scale The brightness of the backscattered electron image is controlled on control software of the scanning electron microscope S-4800 at "Contrast 5" and "Brightness −5", and the backscattered electron image is processed by setting Capture Speed/Accumulate and setting 'Slow 4 to 40 seconds' to form a gray scale image having an image size of 1,280×960 pixels and 8 bit 256 gradations to obtain a projection image of the magnetic carrier (FIG. 3A). From the scale on the image, the length of one pixel is 0.1667 μm, and the area of one pixel is 0.0278 $\mu m^2$.

Subsequently, using the projection image obtained from backscattered electrons, the area ratio (percent by area) of portions derived from a metal oxide is calculated on 50 magnetic carrier particles. A method for selecting 50 magnetic carrier particles for analysis will be described later in detail. The percent by area of the portions derived from the metal oxide is computed using image processing software, Image-Pro Plus 5.1J (manufactured by Media Cybernetics, Inc.).

Figure 3D:
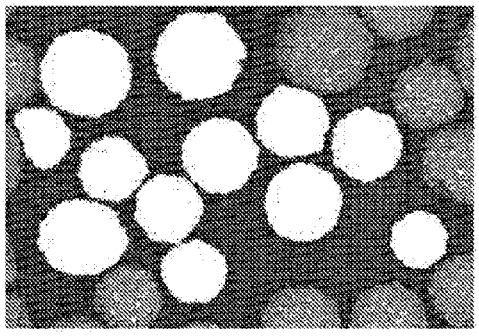
Figure 3B:
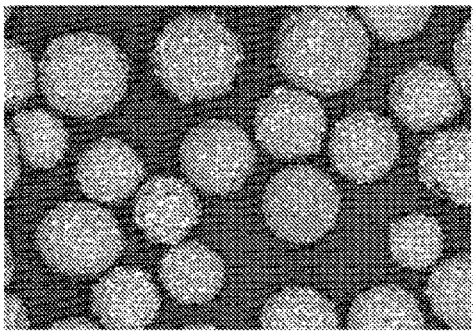

First, a string of letters at the bottom of the image in FIG. 3A is unnecessary for image processing, and hence this unnecessary part is deleted to cut out the image into a size of 1,280×895 (FIG. 3B).

Next, portions of the magnetic carrier particles are extracted, and the sizes of the portions of the magnetic carrier particle thus extracted are counted. In particular, first, in order to extract a magnetic carrier particle to be analyzed, the magnetic carrier particle is separated from the background part. "Measurement"–"Count/Size" of Image-Pro Plus 5.1J is selected. By "Intensity Range Selection" of "Count/Size", the intensity range is set in a range of 50 to 255 to remove a low-intensity carbon tape portion shown as the background, so that the magnetic carrier particle is extracted (FIG. 3C). When the magnetic carrier particle is fixed by a method other than that using a carbon tape, the background does not always form a low-intensity region, and the probability in which the background partially has an intensity similar to that of the magnetic carrier particle cannot be completely denied. However, the boundary between the magnetic carrier particle and the background can be easily distinguished from an observation image of backscattered electrons. When the extraction is performed, 4-Connect is selected in Object Options of "Count/Size", Smooth 5 is input, a check mark is put for Fill Holes to exclude from calculation any particles positioned on all boundaries (peripheries) of the image and overlapped with other particles. Next, Area and Ferret's Diameter (Average) are selected from the measurement menu in "Count/Size", and Filter Range of the area is set to 300 pixels in minimum and 10,000,000 pixels in maximum. In addition, as for Ferret's Diameter (Average), Filter Range is set so as to be in a range of ±25% of the measured value of the volume distribution base 50% particle diameter (D50) of the magnetic carrier which will be described later, and a magnetic carrier particle to be image-analyzed is extracted (FIG. 3D). One particle from the group of the particles thus extracted is selected to obtain the size (the number of pixels) of the portion derived from the particle (total projection area thereof).

Figure 3E:
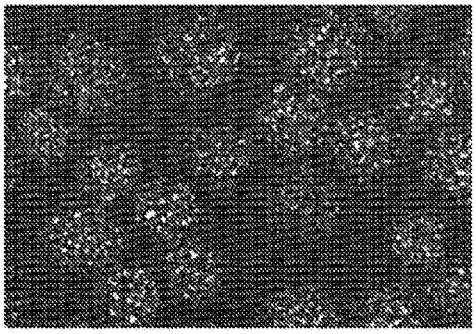
Figure 3C:
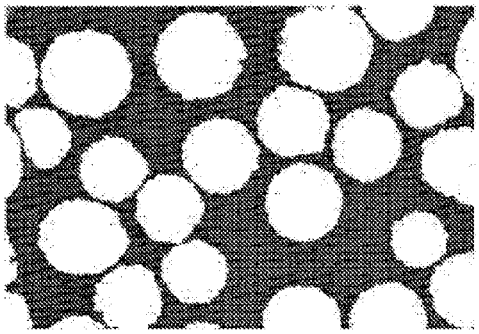

Next, on "Intensity Range Selection" of "Count/Size" of Image-Pro Plus 5.1J, the intensity range is set in a range of 140 to 255 to extract the portions having high luminance on the magnetic carrier particle (FIG. 3E). Filter Range of the area is set to 10 pixels in minimum and 10,000 pixels in maximum.

Next, as for the particle selected as described above, the size (the number of pixels) of the portions having high luminance derived from the porous magnetic core particle on the surface of the magnetic carrier particle (the total area of the portions having high luminance derived from the porous magnetic core particle on one magnetic carrier particle) is obtained. Furthermore, the ratio of the portions having high luminance derived from the porous magnetic core particle is obtained by (the total area of portions having high luminance derived from porous magnetic core particle on one magnetic carrier particle/total projection area of the magnetic carrier particle)×100.

Subsequently, for the respective particles in the group of the particles thus extracted, processing similar to that described above is performed until the number of selected magnetic carrier particles reaches 50. If the number of particles in one visual field does not reach 50, an operation similar to that described above is repeatedly performed for a projection image of magnetic carrier particles in another visual field. As the ratio $S_1$ of the portions having high luminance derived from the porous magnetic core particle, the average of the ratio of the portions having high luminance derived from the porous magnetic core particle to the magnetic carrier particle is used.

Method for Measuring Weight Average Molecular Weight (Mw) of Binder Resin of Toner The weight average molecular weight (Mw) is measured by a gel permeation chromatography (GPC) as described below.

First, a sample is dissolved in tetrahydrofuran (THF) over 24 hours at room temperature. The resin or the toner is used as the sample. In addition, the solution thus obtained is filtered using a solvent-resistance membrane filter "Maeshori Disc" (manufactured by Tosoh Corp.) having a pore diameter of 0.2 μm, so that a sample solution is obtained. In this case, the sample solution is prepared so that the concentration of components soluble in THF is approximately 0.8 percent by mass. The measurement is performed using this solution under the following conditions.

Apparatus: HLC8120 GPC (Detector: RI) (manufactured by Tosoh Corp.)

Column: combination of seven columns, Shodex KF-801, 802, 803, 804, 805, 806, and 807 (manufactured by Showa Denko K.K.)

Eluent: tetrahydrofuran (THF)

Flow rate: 1.0 ml/min

Oven temperature: 40.0° C.

Amount of injected sample: 0.10 ml

To calculate the molecular weight of the sample, a molecular weight calibration curve is used which is prepared using a standard polystyrene resin (for example, trade name "TSK Standard Polystyrene F-850, F-450, F-288, F-128, F-80, F-40, F-20, F-10, F-4, F-2, F-1, A-5000, A-2500, A-1000, and A-500, manufactured by Tosoh Corp.).

Measurement Method of R/Si Ratio of Silicone Resin

Measurement of the R/Si ratio of the silicone resin is performed by analyzing an uncured silicone resin. Since NMR measurement of a silicone resin after curing is difficult to perform, an uncured silicone resin from which a solvent is removed is measured.

A concrete measurement method is as follows. A solvent of a silicone resin solution used to fill the porous magnetic core particle is distilled off at a reduced pressure, and vacuum drying is performed for whole two days. The resin solid content thus obtained is dissolved in heavy dichloromethane. The resin solution thus obtained is measured using Si-NMR (ACP-300, manufactured by Bruker). From the obtained Si-NMR spectrum, a peak between −19.0 to −25.0 ppm is assigned to Si of the D-unit, and a peak between −63.0 to −71.0 ppm was assigned to Si of the T-unit. The calculation method for R/Si is as follows. If the amount of Si of the D-unit is represented by d, the amount of R bonded to Si of the D-unit is represented by 2d. In addition, if the amount of Si of the T-unit is represented by t, the amount of R bonded to Si of the T-unit is represented by t. Therefore, R/Si can be computed by the following formula.

$$R/Si=(2d+t)/(d+t) \quad \text{[Math. 1]}$$

EXAMPLES

Manufacturing Example of Porous Magnetic Core Particle 1

Step 1: Weighing and Mixing Step

| | |
|---|---|
| $Fe_2O_3$ | 61.9 parts by mass |
| $MnCO_3$ | 31.0 parts by mass |
| $Mg(OH)_2$ | 6.5 parts by mass |
| $SrCO_3$ | 0.6 parts by mass |

The above ferrite raw materials were weighed so as to obtain the above composition ratio. Subsequently, grinding and mixing were performed for 5 hours by a dry type vibration mill using stainless steel beads having a diameter of ⅛ inch.

Step 2: Calcination Step

The obtained ground product was formed by a roller compactor into pellets having approximately 1 mm square. By using a vibration screen having an opening of 3 mm, coarse particles are removed from the above pellets, and subsequently, fine particles were removed using a vibration screen having an opening of 0.5 mm. Then, using a burner type firing furnace, calcination was performed in the air at a temperature of 950° C. for 2 hours, so that calcined ferrite was produced. The composition of the obtained calcined ferrite is as follows.

$$(MnO)_a(MgO)_b(SrO)_c(Fe_2O_3)_d$$

In the above formula, a=0.349, b=0.144, c=0.005, and d=0.502 hold.

Step 3: Grinding Step

After the calcined ferrite was ground to a size of approximately 0.3 mm by a crusher, 30 parts by mass of water was added to 100 parts by mass of the calcined ferrite, and grinding was performed by a wet ball mill for 1 hour using stainless steel beads having a diameter of ⅛ inch. The slurry was ground for 4 hours by a wet ball mill using stainless steel beads having a diameter of 1/16 inch, so that a ferrite slurry (finely ground calcined ferrite) was obtained.

Step 4: Granulation Step

To the ferrite slurry, 1.0 part by mass of a polycarboxylic acid ammonium (dispersant) and 2.0 parts by mass of a poly(vinyl alcohol) (binder) with respect to 100 parts by mass of the calcined ferrite were added, and by a spray dryer (manufactured by Ohkawara Kakohki Co., Ltd.), spherical particles were granulated. After the obtained particles were size-controlled, heating at 650° C. for 2 hours was performed using a rotary kiln, so that the organic components, such as the dispersant and/or the binder, were removed.

Step 5: Firing Step

In order to control a firing atmosphere, in an electric furnace, the temperature was increased from room temperature to 1,150° C. in a nitrogen atmosphere (oxygen concentration: 0.01 percent by volume) for 3 hours, and firing was then performed at a temperature of 1,150° C. for 4 hours. Subsequently, the temperature was decreased to a temperature of 80° C. over 8 hours, the nitrogen atmosphere was returned to the air, and a fired product was recovered at a temperature of 40° C. or less.

Step 6: Sorting Step

After agglomerated particles were cracked, a low magnetic product was removed by magnetic separation, and screening was carried out using a screen having an opening of 250 μm to remove coarse particles, so that a porous magnetic core particle 1 having a volume distribution base 50% particle diameter (D50) of 35.1 μm was obtained. D50, the resistivity at an electric field strength of 300 V/cm, the pore volume, and the average pore diameter are shown in Table 1.

Manufacturing Examples of Porous Magnetic Core Particles 2 to 14

Porous magnetic core particles 2 to 14 were obtained in a manner similar to that of Manufacturing Example 1 except that the manufacturing conditions were changed as shown in Table 1. D50, the resistivity at an electric field strength of 300 V/cm, the pore volume in a pore diameter range of 0.1 to 3.0 μm, and the average pore diameter of each of the porous magnetic core particles 2 to 14 are shown in Table 1. In Table 1, PVA represents a poly(vinyl alcohol).

TABLE 1

PHYSICAL PROPERTIES OF POROUS MAGNETIC CORE PARTICLE AND BULK MAGNETIC CORE PARTICLE

| | Step 1 (Weighing and mixing) Raw material composition (Percent by mass) | | | | Step 2 (Calcination) Calcined ferrite | | | | Step 3 (Grinding) Ball mill | | Step 4 (Granulation) |
|---|---|---|---|---|---|---|---|---|---|---|---|
| | $Fe_2O_3$ | $MnCO_3$ | $Mg(OH)_2$ | $SrCO_3$ | MnO | MgO | SrO | $Fe_2O_3$ | Beads (1/16 inches) | Time (h) | Binder Pva (Parts by mass) |
| Porous magnetic core particle 1 | 61.9 | 31.0 | 6.5 | 0.6 | 0.349 | 0.144 | 0.005 | 0.502 | Stainless steel | 4 | 2.0 |
| Porous magnetic core particle 2 | 61.9 | 31.0 | 6.5 | 0.6 | 0.349 | 0.144 | 0.005 | 0.502 | Stainless steel | 4 | 2.0 |
| Porous magnetic core particle 3 | 61.9 | 31.0 | 6.5 | 0.6 | 0.349 | 0.144 | 0.005 | 0.502 | Stainless steel | 4 | 2.0 |
| Porous magnetic core particle 4 | 61.9 | 31.0 | 6.5 | 0.6 | 0.349 | 0.144 | 0.005 | 0.502 | Stainless steel | 4 | 2.0 |
| Porous magnetic core particle 5 | 80.4 | 11.5 | 7.5 | 0.7 | 0.136 | 0.174 | 0.006 | 0.684 | Stainless steel | 4 | 1.0 |
| Porous magnetic core particle 6 | 80.4 | 11.5 | 7.5 | 0.7 | 0.136 | 0.174 | 0.006 | 0.684 | Stainless steel | 4 | 0.5 |
| Porous magnetic core particle 7 | 61.9 | 31.0 | 6.5 | 0.6 | 0.349 | 0.144 | 0.005 | 0.502 | Stainless steel | 4 | 2.0 |
| Porous magnetic core particle 8 | 61.9 | 31.0 | 6.5 | 0.6 | 0.349 | 0.144 | 0.005 | 0.502 | Stainless steel | 4 | 2.0 |
| Porous magnetic core particle 9 | 61.9 | 31.0 | 6.5 | 0.6 | 0.349 | 0.144 | 0.005 | 0.502 | Zirconia | 6 | 2.0 |
| Porous magnetic core particle 10 | 61.9 | 31.0 | 6.5 | 0.6 | 0.349 | 0.144 | 0.005 | 0.502 | Alumina | 1 | 2.0 |
| Porous magnetic core particle 11 | 61.9 | 31.0 | 6.5 | 0.6 | 0.349 | 0.144 | 0.005 | 0.502 | Stainless steel | 4 | 2.0 |
| Porous magnetic core particle 12 | 61.9 | 31.0 | 6.5 | 0.6 | 0.349 | 0.144 | 0.005 | 0.502 | Stainless steel | 4 | 2.0 |
| Porous magnetic core particle 13 | 61.9 | 31.0 | 6.5 | 0.6 | 0.349 | 0.144 | 0.005 | 0.502 | Stainless steel | 4 | 2.0 |
| Porous magnetic core particle 14 | 61.9 | 31.0 | 6.5 | 0.6 | 0.349 | 0.144 | 0.005 | 0.502 | Stainless steel | 4 | 2.0 |
| Bulk magnetic core particle 1 | 61.9 | 31.0 | 6.5 | 0.6 | 0.349 | 0.144 | 0.005 | 0.502 | Stainless steel | 4 | 2.0 |

| | Step 5 (Firing) Electric furnace | | | Physical properties | | | |
|---|---|---|---|---|---|---|---|
| | Firing temperature (° C.) | Firing time (h) | Oxygen concentration (Percent by volume) | D50 (μm) | Resistivity at electric field strength of 300 V/cm (Ω · cm) | Average pore diameter (μm) | Pore volume ($mm^3/g$) |
| Porous magnetic core particle 1 | 1150 | 4 | 0.01 | 35.1 | $3.0 \times 10^6$ | 1.1 | 63.2 |
| Porous magnetic core particle 2 | 1160 | 4 | 0.01 | 36.0 | $2.9 \times 10^6$ | 1.2 | 54.5 |
| Porous magnetic core particle 3 | 1170 | 4 | 0.01 | 36.3 | $3.0 \times 10^6$ | 1.0 | 45.5 |
| Porous magnetic core particle 4 | 1130 | 4 | 0.01 | 35.8 | $3.2 \times 10^6$ | 1.0 | 78.7 |
| Porous magnetic core particle 5 | 1150 | 4 | 0.30 | 50.4 | $8.1 \times 10^6$ | 1.0 | 62.5 |
| Porous magnetic core particle 6 | 1150 | 4 | 0.01 | 60.2 | $2.4 \times 10^6$ | 1.1 | 64.3 |
| Porous magnetic core particle 7 | 1150 | 4 | 0.50 | 35.3 | $8.8 \times 10^6$ | 1.2 | 63.3 |
| Porous magnetic core particle 8 | 1150 | 4 | 1.00 | 35.4 | $1.1 \times 10^7$ | 1.2 | 63.5 |
| Porous magnetic core particle 9 | 1150 | 4 | 0.01 | 35.1 | $3.1 \times 10^6$ | 0.8 | 63.2 |
| Porous magnetic core particle 10 | 1150 | 4 | 0.01 | 35.1 | $2.9 \times 10^6$ | 1.4 | 63.2 |
| Porous magnetic core particle 11 | 1200 | 4 | 0.01 | 35.7 | $2.7 \times 10^6$ | 1.2 | 35.6 |
| Porous magnetic core particle 12 | 1100 | 4 | 0.01 | 36.0 | $2.8 \times 10^6$ | 1.2 | 94.3 |
| Porous magnetic core particle 13 | 1220 | 5 | 0.01 | 35.0 | $3.1 \times 10^6$ | 1.2 | 33.2 |

TABLE 1-continued

| PHYSICAL PROPERTIES OF POROUS MAGNETIC CORE PARTICLE AND BULK MAGNETIC CORE PARTICLE | | | | | | | |
|---|---|---|---|---|---|---|---|
| Porous magnetic core particle 14 | 1080 | 3 | 0.01 | 35.2 | $3.2 \times 10^6$ | 1.2 | 98.7 |
| Bulk magnetic core particle 1 | 1300 | 3 | 0.01 | 35.8 | $3.4 \times 10^6$ | 0.1 | 0.3 |

Preparation of Silicone Resin 1

| | |
|---|---|
| Polydimethylsiloxane (average polymerization degree: 55) | 5.0 parts by mass |
| Methyltrichlorosilane | 25.0 parts by mass |
| Water | 40.0 parts by mass |
| Methyl isobutyl ketone | 30.0 parts by mass |

Among the above materials, while water and methyl isobutyl ketone were vigorously stirred in a reaction vessel equipped with a reflux condenser, a dripping funnel, and a stirrer so as not to form two layers, a polydimethylsiloxane was further added thereto and stirred, and the reaction vessel was then placed in an ice bath. When the temperature of the mixture in the reaction vessel reached 10° C., methyltrichlorosilane was slowly dripped from the dripping funnel. In this step, the temperature of the reaction mixture was increased to 17° C. After the dripping was completed, the organic layer was washed until neutralized, and subsequently, the organic layer was dried using a drying agent. After the drying agent was removed, the solvent was distilled off at a reduced pressure, and vacuum drying was performed for whole two days, so that a silicone resin 1 was obtained. R/Si of this silicone resin 1 calculated from the NMR spectrum was 1.4.

Preparation of Silicone Resins 2 to 7

Silicone resins 2 to 7 were prepared in a manner similar to that of the preparation of the silicone resin 1 except that materials to be used were changed as shown in Table 2.

Preparation of Silicone Resin Solution 1

The silicone resin 1 in an amount of 19.6 parts by mass, 78.4 parts by mass of toluene, and 2.0 parts by mass of 3-aminopropyl trimethoxysilane were mixed together for 1 hour, so that a silicone resin solution 1 was obtained.

Preparation of Silicone Resin Solutions 2 to 10

Silicone resin solutions 2 to 10 were prepared in a manner similar to that of the preparation of the silicone resin solution 1 except that materials to be used were changed as shown in Table 3.

TABLE 2

| PREPARATION OF SILICONE RESIN | | | | | | | |
|---|---|---|---|---|---|---|---|
| Silicone resin | Material 1 | Polymerization degree | Parts by mass | Material 2 | Parts by mass | Molar ratio of phenyl/methyl | R/Si Ratio |
| Silicone resin 1 | Polydimethylsiloxane | 55 | 5.0 | Methyltrichlorosilane | 25.0 | 0.00 | 1.4 |
| Silicone resin 2 | Polydimethylsiloxane | 40 | 5.0 | Methyltrichlorosilane | 25.0 | 0.00 | 1.3 |
| Silicone resin 3 | Polydimethylsiloxane | 120 | 5.0 | Methyltrichlorosilane | 25.0 | 0.00 | 1.5 |
| Silicone resin 4 | Polydimethylsiloxane | 30 | 5.0 | Methyltrichlorosilane | 25.0 | 0.00 | 1.2 |
| Silicone resin 5 | Polydimethylsiloxane | 200 | 5.0 | Methyltrichlorosilane | 25.0 | 0.00 | 1.6 |
| Silicone resin 6 | Polydimethylsiloxane | 200 | 20.0 | Phenyltrichlorosilane | 10.0 | 0.63 | 1.6 |
| Silicone resin 7 | Polydimethylsiloxane | 200 | 20.0 | 3-Methacryloxypropyltriethoxysilane | 10.0 | 0.00 | 1.6 |

TABLE 3

| PREPARATION OF SILICONE RESIN SOLUTION | | | | | | |
|---|---|---|---|---|---|---|
| Silicone resin solution | Silicone resin | Parts by mass | Silane | Parts by mass | Solvent | Parts by mass |
| Silicone resin solution 1 | Silicone resin 1 | 19.6 | 3-Aminopropyltrimethoxysilane | 2.0 | Toluene | 78.4 |
| Silicone resin solution 2 | Silicone resin 1 | 19.6 | Dimethoxymethylvinylsilane | 2.0 | Toluene | 78.4 |
| Silicone resin solution 3 | Silicone resin 1 | 20.0 | — | — | Toluene | 80.0 |
| Silicone resin solution 4 | Silicone resin 2 | 20.0 | — | — | Toluene | 80.0 |

TABLE 3-continued

PREPARATION OF SILICONE RESIN SOLUTION

| Silicone resin solution | Silicone resin | Parts by mass | Silane | Parts by mass | Solvent | Parts by mass |
|---|---|---|---|---|---|---|
| Silicone resin solution 5 | Silicone resin 3 | 20.0 | — | — | Toluene | 80.0 |
| Silicone resin solution 6 | Silicone resin 4 | 20.0 | — | — | Toluene | 80.0 |
| Silicone resin solution 7 | Silicone resin 5 | 20.0 | — | — | Toluene | 80.0 |
| Silicone resin solution 8 | Silicone resin 6 | 20.0 | — | — | Toluene | 80.0 |
| Silicone resin solution 9 | Silicone resin 7 | 20.0 | — | — | Toluene | 80.0 |
| Silicone resin solution 10 | Silicone resin 6 | 19.6 | 3-Aminopropyltrimethoxysilane | 2.0 | Toluene | 78.4 |

Preparation of Vinyl Resin 1

| | |
|---|---|
| Cyclohexyl methacrylate monomer | 26.8 parts by mass |
| Methyl methacrylate monomer | 0.2 parts by mass |
| Methyl methacrylate macromonomer (Macromonomer having a weight average molecular weight of 5,000 and a methacryloyl group at one terminal) | 8.4 parts by mass |
| Toluene | 31.3 parts by mass |
| Methyl ethyl ketone | 31.3 parts by mass |

The above materials were charged in a four-port separable flask equipped with a reflux condenser, a thermometer, a nitrogen introducing tube, and a stirring device, and a nitrogen gas was introduced to form a sufficient nitrogen atmosphere. Subsequently, after heating was performed to 80° C., 2.0 parts by mass of azobisisobutyronitrile was added, and reflux was performed for 5 hours for polymerization. Hexane was added to the reactant thus obtained to precipitate a copolymer, and the precipitate was separated by filtration, so that a vinyl resin 1 was obtained.

Preparation of Vinyl Resins 2 to 4

Vinyl resins 2 to 4 were prepared in a manner similar to that of the preparation of the vinyl resin 1 except that materials to be used were changed as shown in Table 4.

Preparation of Vinyl Resin Solution 1

The vinyl resin 1 in an amount of 10.0 parts by mass and 90.0 parts by mass of toluene were mixed for 1 hour, so that a vinyl resin solution 1 was obtained.

Preparation of Vinyl Resin Solutions 2 to 8

Vinyl resin solutions 2 to 8 were prepared in a manner similar to that of the preparation of the vinyl resin solution 1 except that the changes shown in Table 5 were performed.

TABLE 4

PREPARATION OF VINYL RESIN

| Vinyl resin | Monomer 1 | Parts by mass | Monomer 2 | Parts by mass | Monomer 3 | Parts by mass |
|---|---|---|---|---|---|---|
| Vinyl resin 1 | Cyclohexyl methacrylate monomer | 26.8 | Methyl methacrylate monomer | 0.2 | Methyl methacrylate macromonomer | 8.4 |
| Vinyl resin 2 | Cyclohexyl methacrylate monomer | 26.8 | Methyl methacrylate monomer | 0.2 | Styrene macromonomer | 8.4 |
| Vinyl resin 3 | Cyclohexyl methacrylate monomer | 34.7 | Methyl methacrylate monomer | 0.7 | — | — |
| Vinyl resin 4 | Cyclopentyl methacrylate monomer | 34.7 | Methyl methacrylate monomer | 0.7 | — | — |
| Vinyl resin 5 | Cyclodecyl methacrylate monomer | 34.7 | Methyl methacrylate monomer | 0.7 | — | — |
| Vinyl resin 6 | Adamantyl methacrylate monomer | 34.7 | Methyl methacrylate monomer | 0.7 | — | — |
| Vinyl resin 7 | Methyl methacrylate monomer | 35.4 | — | — | — | — |
| Vinyl resin 8 | Methyl methacrylate monomer | 28.3 | Styrene monomer | 7.1 | — | — |
| Vinyl resin 9 | Methyl methacrylate monomer | 34.7 | Dimethyl(aminoethyl)methacrylate | 0.7 | — | — |

TABLE 5

PREPARATION OF VINYL RESIN SOLUTION

| Vinyl resin solution | Vinyl resin | Parts by mass | Solvent | Parts by mass |
|---|---|---|---|---|
| Vinyl resin solution 1 | Vinyl resin 1 | 10.0 | Toluene | 90.0 |
| Vinyl resin solution 2 | Vinyl resin 2 | 10.0 | Toluene | 90.0 |
| Vinyl resin solution 3 | Vinyl resin 3 | 10.0 | Toluene | 90.0 |
| Vinyl resin solution 4 | Vinyl resin 4 | 10.0 | Toluene | 90.0 |
| Vinyl resin solution 5 | Vinyl resin 5 | 10.0 | Toluene | 90.0 |
| Vinyl resin solution 6 | Vinyl resin 6 | 10.0 | Toluene | 90.0 |
| Vinyl resin solution 7 | Vinyl resin 7 | 10.0 | Toluene | 90.0 |
| Vinyl resin solution 8 | Vinyl resin 8 | 10.0 | Toluene | 90.0 |
| Vinyl resin solution 9 | BR-73 (Manufactured by MITSUBISHI RAYON CO., LTD.) | 10.0 | Toluene | 90.0 |
| Vinyl resin solution 10 | Vinyl resin 9 | 10.0 | Toluene | 90.0 |

Manufacturing of Magnetic Carrier 1

Resin Filling Step

The porous magnetic core particle 1 in an amount of 100.0 parts by mass was charged in a stirring vessel of a mixing/stirring machine (universal stirring machine NDMV type, manufactured by Dalton Corp.), the temperature was maintained at 60° C., and nitrogen was introduced while the pressure was reduced to 2.3 kPa. In addition, in a reduced-pressure atmosphere, the silicone resin solution 1 was dripped to the porous magnetic core particle 1 so that the amount of the resin component was 7.5 parts by mass. After the dripping was completed, stirring was still continued for 2 hours. Subsequently, the temperature was increased to 70° C., the solvent was removed in a reduced-pressure atmosphere, and the silicone resin composition was filled in the porous magnetic core particle 1.

After cooling was performed, the particles thus obtained were transferred to a mixer (drum mixer UD-AT type, manufactured by Sugiyama Heavy Industrial Co., Ltd.) including a rotary mixing vessel and spiral blades provided therein, and the temperature was increased to 220° C. at a temperature rise rate of 2° C./min in a nitrogen atmosphere at an ordinary pressure. Heating and mixing were performed at this temperature for 60 minutes, so that the resin was cured. Next, a low magnetic product was separated by magnetic separation, and classification was performed using a screen having an opening of 150 μm, so that a filled core particle 1 was obtained. D50, the resistivity at an electric field strength of 1,000 V/cm, and the pore volume in a pore diameter range of 0.1 to 3.0 μm of the filled core particle 1 are shown in Table 7.

Resin Coating Step

Subsequently, in a reduced-pressure atmosphere (1.5 kPa), the vinyl resin solution 1 was charged in a planetary type mixer (Nauta Mixer VN type, manufactured by Hosokawa Micron Corporation) maintained at a temperature of 60° C. so that the content of the resin component was 2.0 parts by mass to 100 parts by mass of the filled core particle 1. As a charging method, one third of the amount of the resin solution was charged, and toluene removal and application operation were performed for 20 minutes. Subsequently, after one third of the amount of the resin solution was further charged, toluene removal and application operation were performed for 20 minutes, and again after one third of the amount of the resin solution was further charged, toluene removal and application operation were performed for 20 minutes. Next, the filled core particle coated with the vinyl resin was transferred to a mixer (drum mixer UD-AT type, manufactured by Sugiyama Heavy Industrial Co., Ltd.) including a rotary mixing vessel and spiral blades provided therein, and a heat treatment was performed at a temperature of 200° C. in a nitrogen atmosphere for 2 hours while stirring was performed by rotating the mixing vessel at 10 rpm. After a low magnetic product of the magnetic carrier was separated by magnetic separation, and the magnetic carrier thus obtained was allowed to pass through a screen having an opening of 70 μm, classification was performed by a pneumatic classifier, so that a magnetic carrier 1 having a volume distribution base 50% particle diameter (D50) of 38.2 μm was obtained. The physical properties of the obtained magnetic carrier are shown in Table 7.

In the magnetic carrier obtained as described above, the amount of the resin component of the vinyl resin solution used for the resin coating step is approximately equivalent to the amount of the vinyl resin actually coating the magnetic carrier. The following operations were performed in order to verify the above result.

A predetermined amount of the magnetic carrier was dipped in chloroform, and the coating resin was dissolved out by applying an ultrasonic wave. The above operation was performed several times, and the magnetic carrier obtained thereby was dried. In addition, from the weight of the magnetic carrier after the drying, an effective coating resin amount was computed. The effective coating resin amount of the magnetic carrier 1 was 2 percent by mass to the filled core particle 1.

Manufacturing of Magnetic Carriers 2 to 34

Magnetic carriers 2 to 34 were manufactured in a manner similar to that of the magnetic carrier 1 except that materials to be used were changed as shown in Table 6. The physical properties of the obtained magnetic carriers are shown in Table 7.

TABLE 6

FORMULATION OF MAGNETIC CARRIER

| Magnetic carrier | Porous magnetic core particle | Resin filling step: Silicone resin solution | Resin filling step: Filled resin amount (Parts by mass) | Filled core particle | Resin coating step: Vinyl resin solution | Resin coating step: Coating amount (Parts by mass) |
|---|---|---|---|---|---|---|
| Magnetic carrier 1 | 1 | 1 | 7.5 | 1 | 1 | 2.0 |
| Magnetic carrier 2 | 1 | 1 | 7.5 | 1 | 2 | 2.0 |
| Magnetic carrier 3 | 1 | 2 | 7.5 | 2 | 3 | 2.0 |
| Magnetic carrier 4 | 1 | 3 | 7.5 | 3 | 4 | 2.0 |
| Magnetic carrier 5 | 2 | 4 | 7.5 | 4 | 5 | 2.0 |
| Magnetic carrier 6 | 2 | 5 | 7.5 | 5 | 6 | 2.0 |
| Magnetic carrier 7 | 1 | 6 | 7.5 | 6 | 3 | 2.0 |
| Magnetic carrier 8 | 1 | 7 | 7.5 | 7 | 3 | 2.0 |
| Magnetic carrier 9 | 1 | 7 | 7.5 | 7 | 6 | 2.0 |
| Magnetic carrier 10 | 1 | 7 | 7.5 | 7 | 7 | 2.0 |
| Magnetic carrier 11 | 3 | 7 | 5.5 | 8 | 7 | 1.5 |
| Magnetic carrier 12 | 4 | 7 | 8.5 | 9 | 7 | 2.5 |
| Magnetic carrier 13 | 1 | 7 | 7.5 | 7 | 7 | 1.2 |
| Magnetic carrier 14 | 1 | 7 | 7.5 | 7 | 7 | 3.0 |
| Magnetic carrier 15 | 5 | 7 | 7.5 | 10 | 7 | 1.7 |
| Magnetic carrier 16 | 6 | 7 | 7.5 | 11 | 7 | 1.5 |
| Magnetic carrier 17 | 7 | 7 | 7.5 | 12 | 7 | 2.0 |
| Magnetic carrier 18 | 8 | 7 | 7.5 | 13 | 7 | 2.0 |
| Magnetic carrier 19 | 9 | 7 | 7.5 | 14 | 7 | 2.0 |
| Magnetic carrier 20 | 10 | 7 | 7.5 | 15 | 7 | 2.0 |
| Magnetic carrier 21 | 1 | 8 | 7.5 | 16 | 7 | 2.0 |
| Magnetic carrier 22 | 1 | 9 | 7.5 | 17 | 7 | 2.0 |
| Magnetic carrier 23 | 1 | 7 | 7.5 | 7 | 8 | 2.0 |
| Magnetic carrier 24 | 1 | 7 | 8.8 | 18 | 7 | 1.5 |
| Magnetic carrier 25 | 1 | 7 | 6.7 | 19 | 7 | 2.5 |
| Magnetic carrier 26 | 11 | 7 | 3.0 | 20 | 7 | 1.3 |
| Magnetic carrier 27 | 12 | 7 | 9.0 | 21 | 7 | 2.8 |
| Magnetic carrier 28 | 1 | 10 | 9.0 | 22 | 9 | 1.0 |
| Magnetic carrier 29 | 1 | 10 | 6.5 | 23 | 9 | 1.0 |
| Magnetic carrier 30 | 1 | 10 | 6.5 | 24 | 9 | 4.0 |
| Magnetic carrier 31 | 13 | 7 | 2.0 | 25 | 7 | 1.0 |
| Magnetic carrier 32 | 14 | 7 | 9.5 | 26 | 7 | 3.5 |
| Magnetic carrier 33 | Bulk magnetic core particle 1 | — | — | Bulk magnetic core particle 1 | 10 | 2.5 |
| Magnetic carrier 34 | 1 | 7 | 7.5 | 7 | * | 1.4 |

(*) Magnetic carrier 34 uses silicone resin solution 7 as the coating resin solution.

TABLE 7

PHYSICAL PROPERTIES OF MAGNETIC CARRIER

| Magnetic carrier | Physical properties of porous magnetic core particle: Porous magnetic core particle | Particle diameter D50 (μm) | Resistivity at electric field strength of 300 V/cm (Ω · cm) | Average pore diameter (μm) | Pore volume ($mm^3/g$) | Physical properties of filled core particle: Filled core particle | Particle diameter D50 (μm) | Resistivity at electric field strength of 1,000 V/cm (Ω · cm) | Pore volume ($mm^3/g$) | Physical properties of magnetic carrier: Particle diameter D50 (μm) | Ratio $S_1$ of portions having high luminance (Percent by area) | Resistivity at electric field strength of 1,000 V/cm (Ω · cm) |
|---|---|---|---|---|---|---|---|---|---|---|---|---|
| 1 | 1 | 35.1 | $3.0 \times 10^6$ | 1.1 | 63.2 | 1 | 35.2 | $8.6 \times 10^6$ | 10.6 | 38.2 | 5.1 | $1.6 \times 10^8$ |
| 2 | 1 | 35.1 | $3.0 \times 10^6$ | 1.1 | 63.2 | 1 | 35.2 | $8.6 \times 10^6$ | 10.6 | 38.3 | 5.2 | $1.7 \times 10^8$ |
| 3 | 1 | 35.1 | $3.0 \times 10^6$ | 1.1 | 63.2 | 2 | 35.3 | $8.5 \times 10^6$ | 10.2 | 38.4 | 5.1 | $1.6 \times 10^8$ |
| 4 | 1 | 35.1 | $3.0 \times 10^6$ | 1.1 | 63.2 | 3 | 35.4 | $8.0 \times 10^6$ | 9.8 | 38.2 | 5.3 | $1.8 \times 10^8$ |
| 5 | 2 | 36.0 | $2.9 \times 10^6$ | 1.2 | 54.5 | 4 | 35.9 | $7.2 \times 10^6$ | 9.2 | 38.5 | 5.2 | $1.6 \times 10^8$ |
| 6 | 2 | 36.0 | $2.9 \times 10^6$ | 1.2 | 54.5 | 5 | 35.7 | $8.4 \times 10^6$ | 10.1 | 38.2 | 5.2 | $1.5 \times 10^8$ |
| 7 | 1 | 35.1 | $3.0 \times 10^6$ | 1.1 | 63.2 | 6 | 36.0 | $7.1 \times 10^6$ | 8.9 | 38.3 | 5.3 | $1.7 \times 10^8$ |
| 8 | 1 | 35.1 | $3.0 \times 10^6$ | 1.1 | 63.2 | 7 | 35.5 | $8.5 \times 10^6$ | 10.3 | 38.0 | 5.5 | $1.6 \times 10^8$ |
| 9 | 1 | 35.1 | $3.0 \times 10^6$ | 1.1 | 63.2 | 7 | 35.5 | $8.5 \times 10^6$ | 10.3 | 38.1 | 4.9 | $1.5 \times 10^8$ |
| 10 | 1 | 35.1 | $3.0 \times 10^6$ | 1.1 | 63.2 | 7 | 35.5 | $8.5 \times 10^6$ | 10.3 | 38.0 | 5.0 | $1.6 \times 10^8$ |
| 11 | 3 | 36.3 | $3.0 \times 10^6$ | 1.0 | 45.5 | 8 | 35.2 | $5.5 \times 10^6$ | 11.0 | 38.6 | 6.6 | $1.4 \times 10^8$ |
| 12 | 4 | 35.8 | $3.2 \times 10^6$ | 1.0 | 78.7 | 9 | 36.0 | $9.1 \times 10^6$ | 9.8 | 38.5 | 4.2 | $1.8 \times 10^8$ |
| 13 | 1 | 35.1 | $3.0 \times 10^6$ | 1.1 | 63.2 | 7 | 35.5 | $8.5 \times 10^6$ | 10.3 | 38.3 | 7.8 | $1.3 \times 10^8$ |
| 14 | 1 | 35.1 | $3.0 \times 10^6$ | 1.1 | 63.2 | 7 | 35.5 | $8.5 \times 10^6$ | 10.3 | 39.0 | 3.1 | $2.5 \times 10^8$ |
| 15 | 5 | 50.4 | $8.1 \times 10^5$ | 1.0 | 62.5 | 10 | 51.2 | $2.5 \times 10^6$ | 10.1 | 52.6 | 4.8 | $4.7 \times 10^7$ |
| 16 | 6 | 60.2 | $2.4 \times 10^5$ | 1.1 | 64.3 | 11 | 60.9 | $1.3 \times 10^6$ | 10.2 | 63.5 | 4.7 | $5.8 \times 10^7$ |

TABLE 7-continued

PHYSICAL PROPERTIES OF MAGNETIC CARRIER

| | Physical properties of porous magnetic core particle | | | | | Physical properties of filled core particle | | | | Physical properties of magnetic carrier | | |
|---|---|---|---|---|---|---|---|---|---|---|---|---|
| Magnetic carrier | Porous magnetic core particle | Particle diameter D50 (μm) | Resistivity at electric field strength of 300 V/cm (Ω · cm) | Average pore diameter (μm) | Pore volume ($mm^3/g$) | Filled core particle | Particle diameter D50 (μm) | Resistivity at electric field strength of 1,000 V/cm (Ω · cm) | Pore volume ($mm^3/g$) | Particle diameter D50 (μm) | Ratio $S_1$ of portions having high luminance (Percent by area) | Resistivity at electric field strength of 1,000 V/cm (Ω · cm) |
| 17 | 7 | 35.3 | $8.8 \times 10^6$ | 1.2 | 63.3 | 12 | 35.3 | $1.8 \times 10^7$ | 10.1 | 38.5 | 5.0 | $8.8 \times 10^8$ |
| 18 | 8 | 35.4 | $1.1 \times 10^7$ | 1.2 | 63.5 | 13 | 35.2 | $8.2 \times 10^7$ | 10.1 | 38.6 | 5.1 | $1.3 \times 10^9$ |
| 19 | 9 | 35.1 | $3.1 \times 10^6$ | 0.8 | 63.2 | 14 | 35.5 | $8.6 \times 10^6$ | 8.0 | 38.0 | 4.1 | $1.9 \times 10^8$ |
| 20 | 10 | 35.1 | $2.9 \times 10^6$ | 1.4 | 63.2 | 15 | 35.5 | $8.7 \times 10^6$ | 12.1 | 38.0 | 6.2 | $1.8 \times 10^8$ |
| 21 | 1 | 35.1 | $3.0 \times 10^6$ | 1.1 | 63.2 | 16 | 35.6 | $8.3 \times 10^6$ | 11.5 | 38.5 | 6.1 | $1.8 \times 10^8$ |
| 22 | 1 | 35.1 | $3.0 \times 10^6$ | 1.1 | 63.2 | 17 | 35.6 | $8.3 \times 10^6$ | 8.6 | 38.5 | 4.5 | $2.1 \times 10^8$ |
| 23 | 1 | 35.1 | $3.0 \times 10^6$ | 1.1 | 63.2 | 7 | 35.5 | $8.5 \times 10^6$ | 10.3 | 38.0 | 5.0 | $1.7 \times 10^7$ |
| 24 | 1 | 35.1 | $3.0 \times 10^6$ | 1.1 | 63.2 | 18 | 35.5 | $9.7 \times 10^6$ | 3.2 | 38.4 | 7.3 | $1.8 \times 10^8$ |
| 25 | 1 | 35.1 | $3.0 \times 10^6$ | 1.1 | 63.2 | 19 | 35.6 | $1.2 \times 10^6$ | 14.8 | 38.6 | 4.2 | $1.3 \times 10^7$ |
| 26 | 11 | 35.3 | $2.7 \times 10^6$ | 1.2 | 35.6 | 20 | 35.4 | $1.1 \times 10^6$ | 7.8 | 38.5 | 7.9 | $1.3 \times 10^7$ |
| 27 | 12 | 35.1 | $2.8 \times 10^6$ | 1.2 | 94.3 | 21 | 35.3 | $7.8 \times 10^6$ | 12.8 | 39.2 | 3.6 | $3.7 \times 10^8$ |
| 28 | 1 | 35.1 | $3.0 \times 10^6$ | 1.1 | 63.2 | 22 | 35.2 | $7.7 \times 10^6$ | 2.9 | 38.3 | 3.1 | $1.8 \times 10^8$ |
| 29 | 1 | 35.1 | $3.0 \times 10^6$ | 1.1 | 63.2 | 23 | 35.3 | $1.0 \times 10^6$ | 15.2 | 38.4 | 7.8 | $9.8 \times 10^6$ |
| 30 | 1 | 35.1 | $3.0 \times 10^6$ | 1.1 | 63.2 | 24 | 35.3 | $1.0 \times 10^6$ | 15.2 | 39.5 | 2.8 | $4.7 \times 10^8$ |
| 31 | 13 | 35.0 | $3.1 \times 10^6$ | 1.2 | 33.2 | 25 | 35.2 | $1.3 \times 10^6$ | 6.9 | 38.3 | 4.9 | $8.8 \times 10^6$ |
| 32 | 14 | 35.2 | $3.2 \times 10^6$ | 1.1 | 98.7 | 26 | 35.2 | $8.4 \times 10^6$ | 13.1 | 40.2 | 7.1 | $5.7 \times 10^8$ |
| 33 | * | 35.8 | $3.4 \times 10^7$ | 0.1 | 0.3 | * | — | — | — | 38.3 | 0.1 | $3.8 \times 10^6$ |
| 34 | 1 | 35.1 | $3.0 \times 10^6$ | 1.1 | 63.2 | 7 | 35.5 | $8.5 \times 10^6$ | 10.3 | 38.7 | 5.3 | $1.6 \times 10^8$ |

(*) Represents bulk magnetic core particle 1.

Manufacturing Example of Amorphous Polyester Resin 1

Terephthalic acid: 299 parts by mass Trimellitic anhydride: 19 parts by mass Polyoxypropylene (2.2)-2,2-bis(4-hydroxyphenyl)propane: 747 parts by mass Titanium dihydroxybis(triethanolaminate): 1 part by mass The materials listed above were charged in a reaction vessel equipped with a condenser tube, a stirrer, and a nitrogen introducing tube. Then, heating was performed to a temperature of 200° C., and a reaction was carried out for 10 hours while nitrogen was introduced and generated water was removed. Subsequently, the pressure was reduced to 10 mmHg, and a reaction was performed for 1 hour, so that an amorphous polyester resin 1 having a weight average molecular weight (Mw) of 6,000 was obtained.

Manufacturing Example of Amorphous Polyester Resin 2

Terephthalic acid: 332 parts by mass Polyoxyethylene (2.2)-2,2-bis(4-hydroxyphenyl)propane: 996 parts by mass Titanium dihydroxybis(triethanolaminate): 1 part by mass The materials listed above were charged in a reaction vessel equipped with a condenser tube, a stirrer, and a nitrogen introducing tube. Then, heating was performed to a temperature of 220° C., and a reaction was carried out for 10 hours while nitrogen was introduced and generated water was removed. Subsequently, 96 parts by mass of trimellitic anhydride was further added, heating was performed to a temperature of 180 C, and a reaction was performed for 2 hours, so that an amorphous polyester resin 2 having a weight average molecular weight (Mw) of 84,000 was obtained.

Manufacturing Example of Toner 1

Amorphous polyester resin 1: 80 parts by mass Amorphous polyester resin 2: 20 parts by mass Paraffin wax (melting point: 75° C.): 7 parts by mass Cyan pigment (C. I. Pigment Blue 15:3 (copper phthalocyanine)): 5 parts by mass 3,5-di-t-butyl salicylic acid aluminum compound: 1 part by mass After the materials listed above were sufficiently mixed together by a Henschel mixer (FM-75 type, manufactured by Mitsui Miike Machinery Co., Ltd.), kneading was performed by a biaxial kneading machine (PCM-30 type, manufactured by Ikegai Co., Ltd.) set at a temperature of 130° C. The obtained kneaded material was cooled, and coarse grinding was carried out to a size of 1 mm or less using a hammer mill, so that a coarse-crushed material was obtained. The obtained coarse-crushed material was pulverized by a collision type air flow pulverizer using a high pressure gas.

Next, the obtained pulverized material was classified by a pneumatic classifier (elbow jet lab EJ-L3, manufactured by Nittetsu Mining CO., Ltd.) using a Coanda effect so that fine and coarse powders were simultaneously removed by classification, and furthermore, surface modification was performed using a mechanical surface modification device (Faculty F-300, manufactured by Hosokawa Micron Corporation). In this step, the number of rotations of a dispersion rotor was set to 7,500 rpm, the number of rotations of a classification rotor was set to 9,500 rpm, a charge amount per one cycle was set to 250 g, and a surface modification time (=cycle time from the end of charge of raw materials to the opening of an exhaust valve) was set to 30 seconds, so that toner particles 1 were obtained.

Subsequently, to 100 parts by mass of the toner particles 1, 1.0 part by mass of rutile type titanium dioxide (volume average particle diameter: 20 nm, surface treatment agent: n-decyltrimethoxysilane), 2.0 parts by mass of silica A (produced by a vapor-phase oxidation method, volume average particle diameter: 40 nm, surface treatment agent: silicone oil), and 2.0 parts by mass of silica B (produced by a sol-gel method, volume average particle diameter: 140 nm, surface treatment agent: silicone oil) were added, and mixing was performed for 15 minutes at a circumferential speed of 30 m/s using a 5-liter Henschel mixer. Then, coarse particles were removed using a screen having an opening of 45 μm, so that a toner 1 was obtained.

Manufacturing Example of Toner 2

In manufacturing of the toner 1, the addition amount of the amorphous polyester resin 1 was changed to 60 parts by mass from 80 parts by mass, the addition amount of the amorphous polyester resin 2 was changed to 40 parts by mass from 20 parts by mass, and the addition amount of the paraffin wax was changed to 3 parts by mass from 7 parts by mass. A toner 2 was manufactured in a manner similar to that of the manufacturing example of the toner 1 except for those described above.

The magnetic carriers and the toners, which were produced as described above, were combined as shown in Table 8, so that two-component developers were produced. The two-component developer was obtained in such a way that 8.0 parts by mass of the toner was added to 92.0 parts by mass of the magnetic carrier, and mixing was then performed for 5 minutes using a V type mixer.

Example 1

A two-component developer 1 was evaluated as described below. As an evaluation machine, a modified imagePRESS C7010VP for digital commercial printing (manufactured by CANON KABUSHIKI KAISHA) was used, the two-component developer 1 was charged into a developing device at a cyan position, and an image output endurance test was performed. The above machine was modified as follows. A mechanism to discharge an excessive magnetic carrier in the developing device therefrom was removed, and a direct current voltage $V_{DC}$ and an alternating current voltage having a frequency of 2.0 kHz and a Vpp of 1.3 kV were applied to a developer support. The direct current voltage $V_{DC}$ for evaluation of image output endurance was adjusted so that the amount of toner of an FFh image (solid image) provided on a sheet was 0.55 mg/cm$^2$. FFh is a value representing 256 gradations in hexadecimal number, 00h represents the first gradation (white background portion), and FFh represents the 256th gradation (solid portion).

As the image output endurance test, under ordinary temperature and ordinary humidity conditions (at a temperature of 23° C. and a humidity RH of 50%, hereinafter referred to as "N/N"), a band chart of the FFh output at an image ratio of 5% was printed on A4 paper, and 10,000 pieces thereof were output. In addition, as the A4 paper, POD super gloss 170 (basis weight: 128 g/cm$^2$, thickness: 0.17 mm, manufactured by Oji Paper Co., Ltd.) was used.

Evaluation was performed on the following valuation methods. The results are shown in Table 9.

Glossiness

The difference in glossiness of the fixed image before and after the endurance test was evaluated. The glossiness of fixed image was evaluated by selecting a 60° measurement angle mode using a handy gloss meter PG-3D (manufactured by Nippon Denshoku Industries Co., Ltd.) in accordance with JIS Z 8741. In this measurement, the glossiness is an average value obtained from the values measured at 5 points located at the center and the four corners of a measurement image. As an image for glossiness evaluation, $V_{DC}$ was controlled, an FFh image was formed all over A4 paper, and a fixing temperature was set to 180° C. In addition, as paper forming a fixed image, commercial available glossy paper "POD supergloss 170 (manufactured by Oji Paper Co., Ltd.) (basis weight: 128 g/cm$^2$, thickness: 0.17 mm)" having an A4 size was used.

A: The difference in glossiness before and after the endurance test is less than 5.0%.

B: The difference in glossiness before and after the endurance test is 5.0% to less than 10.0%.

C: The difference in glossiness before and after the endurance test is 10.0% to less than 15.0%.

D: The difference in glossiness before and after the endurance test is 15.0% or more Fogging Fogging after the endurance test was evaluated. $V_{DC}$ was controlled so that Vback was 150V, one sheet of the 00h image was output, and an average reflectance Dr (%) on the paper was measured by a reflectometer ("REFLECTOMETER MODEL TC-6DS", manufactured by Tokyo Denshoku CO., LTD.). In addition, reflectance Ds (%) on the paper on which no image was output was measured. Fogging (%) was computed from the following formula.

$$\text{Fogging}(\%)=Dr(\%)-Ds(\%)$$

A: Fogging is less than 0.5%.

B: Fogging is 0.5% to less than 1.0%.

C: Fogging is 1.0% to less than 2.0%.

D: Fogging is 2.0% or more.

Carrier Adhesion

The carrier adhesion after the endurance test was evaluated. $V_{DC}$ was controlled so that Vback was 100V, the 00h image was output, and sampling was performed in such a way that a transparent adhesive tape was brought into close contact with an electrostatic latent image support. Subsequently, the number of magnetic carrier particles adhered to the electrostatic latent image support in an area of 1 cm by 1 cm was counted, so that the number of adhered carrier particles per one square cm was obtained.

A: The number of adhered carrier particles per one square cm is 3 or less.

B: The number of adhered carrier particles per one square cm is 4 to 10.

C: The number of adhered carrier particles per one square cm is 11 to 20.

D: The number of adhered carrier particles per one square cm is 21 or more.

Leakage Test: White Spot

The leakage after the endurance test was evaluated. By controlling $V_{DC}$, the solid (FFh) image was continuously printed on 5 pieces of A4 regular paper. In the output solid image, the number of white-out points (white spots) having a diameter of 1 mm or more was counted. In addition, the total number of white spots in the five solid images was computed.

A: Total number of white spots is 0.

B: Total number of white spots is 1 to 9.

C: Total number of white spots is 10 to 19.

D: Total number of white spots is 20 or more.

Density Unevenness

The density unevenness after the endurance test was evaluated. $V_{DC}$ was controlled, and the 90h image was output over A4 paper. The image density of the 90h image was measured at arbitrary five points, and the difference between the maximum value and the minimum value was obtained. The image density was measured using an X-Rite color reflection densitometer (Color reflection densitometer X-Rite 404A), and evaluation was performed based on the following criteria.

A: The difference between the maximum value and the minimum value of the image density is less than 0.04.

B: The difference between the maximum value and the minimum value of the image density is 0.04 to less than 0.08.

C: The difference between the maximum value and the minimum value of the image density is 0.08 to less than 0.12.

D: The difference between the maximum value and the minimum value of the image density is 0.12 or more.

Examples 2 to 28 and Comparative Examples 1 to 7

Evaluation was performed in a manner similar to that in Example 1 except that the two-component developers 2 to 35 were used. The evaluation results are shown in Table 8.

TABLE 8

EVALUATION RESULTS

| | Two-component developer | Magnetic carrier | Toner | N/N | | | | | | | | | | | |
|---|---|---|---|---|---|---|---|---|---|---|---|---|---|---|---|
| | | | | Glossiness | | | Fogging | | Carrier adhesion | | Leakage | | Density unevenness | |
| Example 1 | 1 | 1 | 1 | A | 48⇒48 | 0.0% | A | 0.3% | A | 0 | A | 0 | A | 0.2 |
| Example 2 | 2 | 2 | 1 | A | 48⇒47 | 2.1% | A | 0.3% | A | 0 | A | 0 | A | 0.2 |
| Example 3 | 3 | 3 | 1 | A | 48⇒46 | 4.2% | A | 0.3% | A | 0 | A | 0 | B | 0.4 |
| Example 4 | 4 | 4 | 1 | A | 48⇒46 | 4.2% | A | 0.3% | A | 0 | B | 1 | B | 0.4 |
| Example 5 | 5 | 5 | 1 | A | 48⇒46 | 4.2% | A | 0.3% | A | 0 | B | 5 | B | 0.6 |
| Example 6 | 6 | 6 | 1 | A | 48⇒46 | 4.2% | A | 0.3% | B | 4 | B | 5 | B | 0.7 |
| Example 7 | 7 | 7 | 1 | A | 48⇒46 | 4.2% | A | 0.3% | A | 0 | C | 10 | C | 0.8 |
| Example 8 | 8 | 8 | 1 | A | 48⇒46 | 4.2% | A | 0.3% | B | 8 | C | 10 | C | 0.8 |
| Example 9 | 9 | 9 | 1 | A | 48⇒46 | 4.2% | A | 0.3% | B | 8 | C | 10 | C | 0.8 |
| Example 10 | 10 | 10 | 1 | A | 48⇒46 | 4.2% | B | 0.8% | B | 8 | C | 10 | C | 0.8 |
| Example 11 | 11 | 11 | 1 | A | 48⇒46 | 4.2% | B | 0.9% | B | 8 | C | 10 | C | 0.8 |
| Example 12 | 12 | 12 | 1 | A | 48⇒46 | 4.2% | B | 0.9% | B | 8 | C | 10 | C | 0.8 |
| Example 13 | 13 | 13 | 1 | B | 48⇒45 | 6.3% | C | 1.0% | B | 8 | C | 10 | C | 0.8 |
| Example 14 | 14 | 14 | 1 | A | 48⇒46 | 4.2% | C | 1.1% | C | 11 | C | 10 | C | 0.8 |
| Example 15 | 15 | 15 | 1 | A | 48⇒46 | 4.2% | B | 0.8% | B | 9 | C | 11 | C | 0.8 |
| Example 16 | 16 | 16 | 1 | A | 48⇒46 | 4.2% | B | 0.8% | B | 9 | C | 12 | C | 0.8 |
| Example 17 | 17 | 17 | 1 | A | 48⇒46 | 4.2% | B | 0.8% | C | 11 | C | 10 | C | 0.8 |
| Example 18 | 18 | 18 | 1 | A | 48⇒46 | 4.2% | B | 0.8% | C | 12 | C | 10 | C | 0.8 |
| Example 19 | 19 | 10 | 2 | B | 32⇒30 | 6.3% | B | 0.8% | B | 8 | C | 10 | C | 0.8 |
| Example 20 | 20 | 19 | 2 | A | 32⇒31 | 3.1% | B | 0.8% | B | 8 | C | 10 | C | 0.8 |
| Example 21 | 21 | 20 | 2 | B | 32⇒29 | 9.3% | C | 1.1% | B | 8 | C | 10 | C | 0.8 |
| Example 22 | 22 | 21 | 2 | B | 32⇒30 | 6.3% | B | 0.8% | B | 8 | C | 10 | C | 0.8 |
| Example 23 | 23 | 22 | 2 | B | 32⇒30 | 6.3% | B | 0.8% | B | 8 | C | 10 | C | 0.8 |
| Example 24 | 24 | 23 | 2 | B | 32⇒30 | 6.3% | C | 1.1% | B | 8 | C | 10 | C | 0.8 |
| Example 25 | 25 | 24 | 2 | C | 32⇒28 | 12.5% | C | 1.2% | B | 8 | C | 10 | C | 0.8 |
| Example 26 | 26 | 25 | 2 | C | 32⇒28 | 12.5% | C | 1.2% | B | 8 | C | 10 | C | 0.8 |
| Example 27 | 27 | 26 | 2 | B | 32⇒30 | 6.3% | C | 1.7% | B | 8 | C | 16 | C | 0.8 |
| Example 28 | 28 | 27 | 2 | A | 32⇒31 | 3.1% | C | 1.1% | B | 10 | C | 10 | C | 0.8 |
| Comparative example 1 | 29 | 28 | 1 | D | 48⇒38 | 20.8% | C | 1.2% | B | 8 | C | 10 | C | 0.8 |
| Comparative example 2 | 30 | 29 | 1 | D | 48⇒38 | 20.8% | C | 1.2% | B | 8 | C | 10 | C | 0.8 |
| Comparative example 3 | 31 | 30 | 1 | A | 48⇒46 | 4.2% | D | 2.1% | C | 20 | C | 10 | C | 0.8 |
| Comparative example 4 | 32 | 31 | 1 | B | 48⇒45 | 6.3% | C | 1.1% | C | 16 | D | 21 | C | 0.8 |
| Comparative example 5 | 33 | 32 | 1 | A | 48⇒46 | 4.2% | C | 1.1% | D | 21 | C | 10 | C | 0.8 |
| Comparative example 6 | 34 | 33 | 1 | A | 48⇒46 | 4.2% | D | 2.7% | B | 8 | D | 23 | C | 0.8 |
| Comparative example 7 | 35 | 34 | 2 | D | 32⇒24 | 25.0% | C | 1.1% | B | 8 | C | 10 | C | 0.8 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-144644, filed Jun. 29, 2011, which is hereby incorporated by reference herein in its entirety.

REFERENCE SIGNS LIST

1 Resin Container
2 Lower Electrode
3 Pedestal
4 Upper Electrode
5 Sample
6 Electrometer
7 Control Computer
A Resistance Measurement Cell
d Sample Height
d1 Height provided with no Sample
d2 Height provided with Sample

The invention claimed is:

1. A magnetic carrier comprising:

a filled core particle including a porous magnetic core particle and a silicone resin filled in pores thereof; and a vinyl resin coating a surface of the filled core particle, wherein in a pore distribution of the porous magnetic core particle measured by a mercury intrusion method, a cumulative pore volume of the porous magnetic core particle is 35.0 to 95.0 $mm^3/g$, in a pore distribution of the filled core particle measured by a mercury intrusion method, a cumulative pore volume of the filled core particle is 3.0 to 15.0 $mm^3/g$, the content of the vinyl resin is 1.2 to 3.0 parts by mass with respect to 100.0 parts by mass of the filled core particle, and the mercury intrusion method comprises the following steps:

weighing 1.0 g of the porous magnetic core particle or the filled core particle, intruding a mercury into the pores of the porous magnetic core particle or the filled core particle while measuring a mercury intrusion pressure and a volume of the intruded mercury in a range of 13.8 kPa to 315.6 kPa and in a range of 316.3 kPa to 413.6 MPa, obtaining the pore distribution of the porous magnetic core particle or the filled core particle, by calculation from the mercury intrusion pressure and the volume of the intruded mercury, and computing the cumulative pore volume of the porous magnetic core particle or the filled core particle by integrating a Log differential pore volume in a pore diameter range of 0.1 to 3.0 μm in the pore distribution of the porous magnetic core particle or the filled core particle, wherein the vinyl resin is a copolymer of a vinyl monomer having a cyclic hydrocarbon group in its molecular structure, and a methyl methacrylate macromonomer having a methacryloyl group at one terminal thereof.

2. A two-component developer comprising:

a magnetic carrier; and a toner, wherein the toner includes an inorganic fine powder and toner particles containing a binder resin, a coloring agent, and a wax, and the magnetic carrier is the magnetic carrier according to claim 1.

* * * * *